US007803057B2

(12) United States Patent
De Souza

(10) Patent No.: US 7,803,057 B2
(45) Date of Patent: Sep. 28, 2010

(54) EXPANSIBLE AMUSEMENT DEVICE

(76) Inventor: Angus Thomas De Souza, 3605 241st Ave. SE., Issaquah, WA (US) 98029

( * ) Notice: Subject to any disclaimer, the term of this patent is extended or adjusted under 35 U.S.C. 154(b) by 364 days.

(21) Appl. No.: 12/155,202

(22) Filed: May 30, 2008

(65) Prior Publication Data

US 2009/0298601 A1 Dec. 3, 2009

(51) Int. Cl.
*A63H 37/00* (2006.01)
*A63H 33/00* (2006.01)

(52) U.S. Cl. ..... 472/51; 448/5

(58) Field of Classification Search ..... 472/51
See application file for complete search history.

(56) References Cited

U.S. PATENT DOCUMENTS

| | | | | |
|---|---|---|---|---|
| 2,936,939 | A | | 5/1960 | Lundquist |
| 3,661,319 | A | | 5/1972 | Koehler |
| 4,274,222 | A | | 6/1981 | Zahn et al. |
| 4,418,861 | A | | 12/1983 | McFarland et al. |
| 4,711,062 | A | | 12/1987 | Gwilliam et al. |
| 4,793,546 | A | | 12/1988 | Nunn |
| 4,794,024 | A | | 12/1988 | Crowell et al. |
| 5,096,751 | A | | 3/1992 | Duchek |
| 5,531,628 | A | | 7/1996 | Watkins |
| 5,536,194 | A | * | 7/1996 | Larsen et al. ..... 446/5 |
| 5,597,112 | A | * | 1/1997 | Knapp ..... 229/116 |
| 5,937,553 | A | | 8/1999 | Maran |
| 6,006,457 | A | | 12/1999 | Transport |
| D437,557 | S | | 2/2001 | Ingelin et al. |
| 6,287,226 | B1 | | 9/2001 | Dilling |
| 6,371,363 | B1 | | 4/2002 | Franklin et al. |

OTHER PUBLICATIONS

S. Johnson and H. Walser, "The Pop-Up Octahedron", *Mathematics in School,* vol. 25, No. 5, Nov. 1997, 2-4.

* cited by examiner

*Primary Examiner*—Gene Kim
*Assistant Examiner*—Michael D Dennis
(74) *Attorney, Agent, or Firm*—Richard C. Litman

(57) ABSTRACT

The expansible amusement device is a compressed package formed from paper goods, plastic goods or the like, which, under selective decompression, disperses confetti and generates acoustic effects. A plurality of elastically expandable members are stacked together and compressed between a pair of bases. A plurality of confetti strips are positioned between adjacent elastically expandable members when the expansible amusement device is in the compressed configuration, and a deployment strip is peripherally wrapped about the compressed device. The deployment strip has a free end and a fixed end, and at least one retaining member releasably secures the fixed end of the deployment strip to the pair of bases when the expansible amusement device is in the compressed configuration.

20 Claims, 45 Drawing Sheets

12

EXPANSIBLE AMUSEMENT DEVICE

BACKGROUND OF THE INVENTION

1. Field of the Invention

The present invention relates to novelties and party devices, and particularly to an expansible amusement device that can disperse confetti and other objects, as well as generate acoustic effects.

2. Description of the Related Art

Amusement devices, such as "party poppers" are well known. Party poppers are typically used at parties and other festive events to generate noise and disperse confetti. Party poppers typically emit a loud popping noise through the use of a small friction-actuated explosive charge, decompression of a spring, or by decompression of a compressed air charge. Actuation is typically initiated through the pulling of an attached string or rotary mechanism.

Conventional party poppers may be dangerous, due to the explosives or highly pressurized gases used therein. Further, the confetti or streamers which are deployed may present a fire hazard, particularly in combination with explosives. Additionally, such devices are non-reusable. Further, conventional party poppers and other amusement devices result in a great deal of waste, such as wrappers, the used confetti, environmental contaminants and other pieces and waste products. It would be desirable to provide an amusement device which is safe to use, particularly around children, and which is also reusable.

Thus, an expansible amusement device solving the aforementioned problems is desired.

SUMMARY OF THE INVENTION

The expansible amusement device is a compressed package formed from paper or plastic goods or the like, which, under selective decompression, disperses confetti and generates acoustic effects.

The expansible amusement device includes a pair of bases having a substantially planar shape. A plurality of elastically expandable members having a substantially planar shape, when in a compressed state, are stacked and sandwiched between the pair of bases when the expansible amusement device is in a compressed configuration.

A plurality of confetti strips are positioned between adjacent ones of the plurality of elastically expandable members when the expansible amusement device is in the compressed configuration. A deployment strip is peripherally wrapped about the pair of bases and the plurality of elastically expandable members when the expansible amusement device is in the compressed configuration.

The deployment strip has a free end and a fixed end, and at least one retaining member releasably secures the fixed end of the deployment strip to the pair of bases when the expansible amusement device is in the compressed configuration. In use, the user grasps the free end of the deployment strip and tosses the expansible amusement device in order to deploy the expansible amusement device. The tossing of the expansible amusement device, while the user grasps the free end of the deployment strip, causes the at least one retaining member and the deployment strip to separate from the pair of bases. Removal of the compressive force caused by the pair of bases, the at least one retaining member and the deployment strip allows the plurality of elastically expandable members to expand and disperse, thus dispersing the plurality of confetti strips and the base members, as well as generating acoustic effects due to the elastic decompression.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
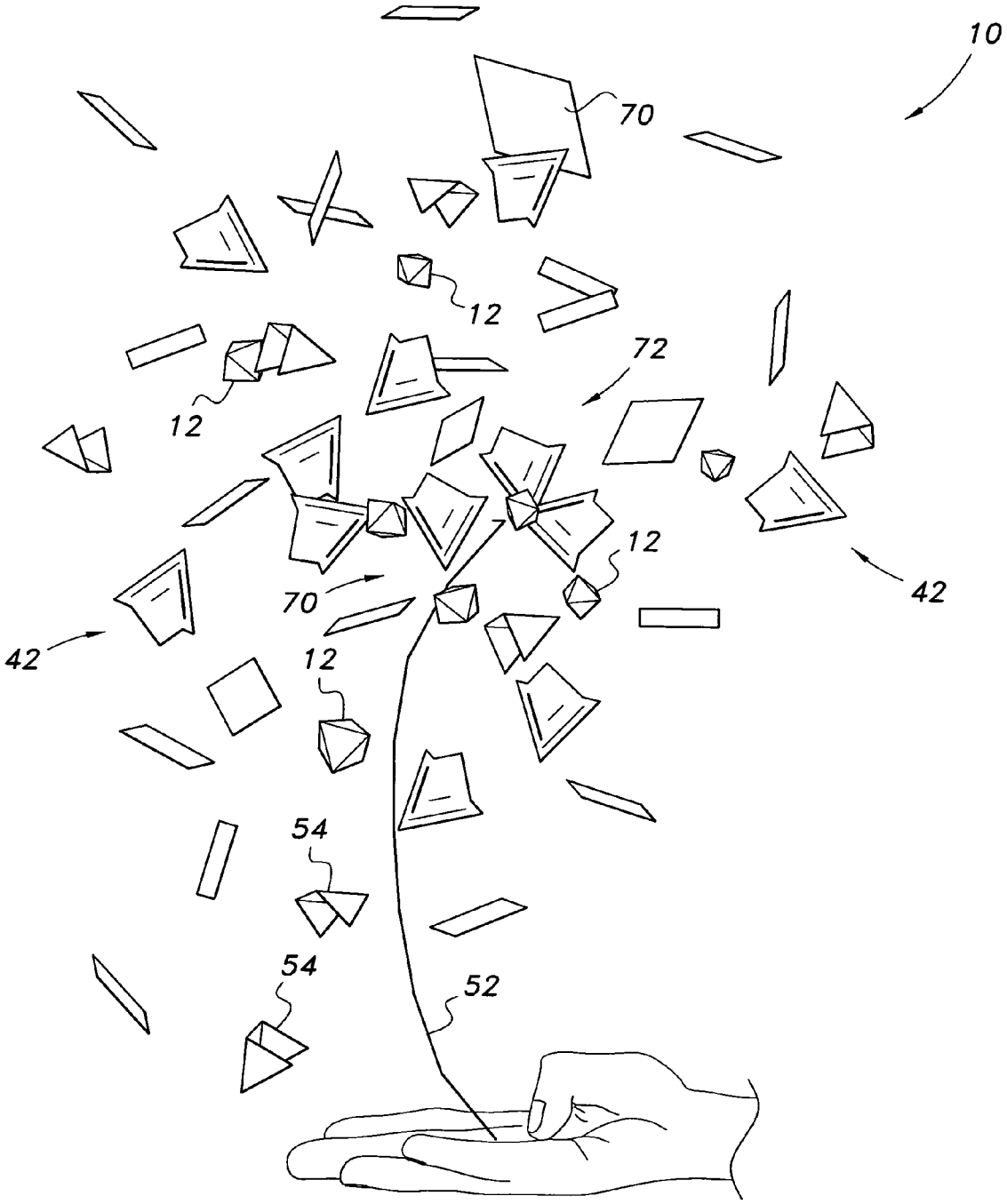
FIG. 1 is a perspective view of an expansible amusement device according to the present invention, shown in a deployed state.

The present invention is directed towards an expansible amusement device 10. The expansible amusement device is a compressed package formed from paper goods, plastic goods or the like which, under selective decompression, deploys or disperses confetti or the like in an energetic or explosive burst pattern (although without the use of an explosive material), as shown in FIG. 1, and further generates acoustic effects. The expansible amusement device may be formed from any suitable material, such as, for example, paper, plastic, paperboard, cardboard or the like.

Figure 4A:
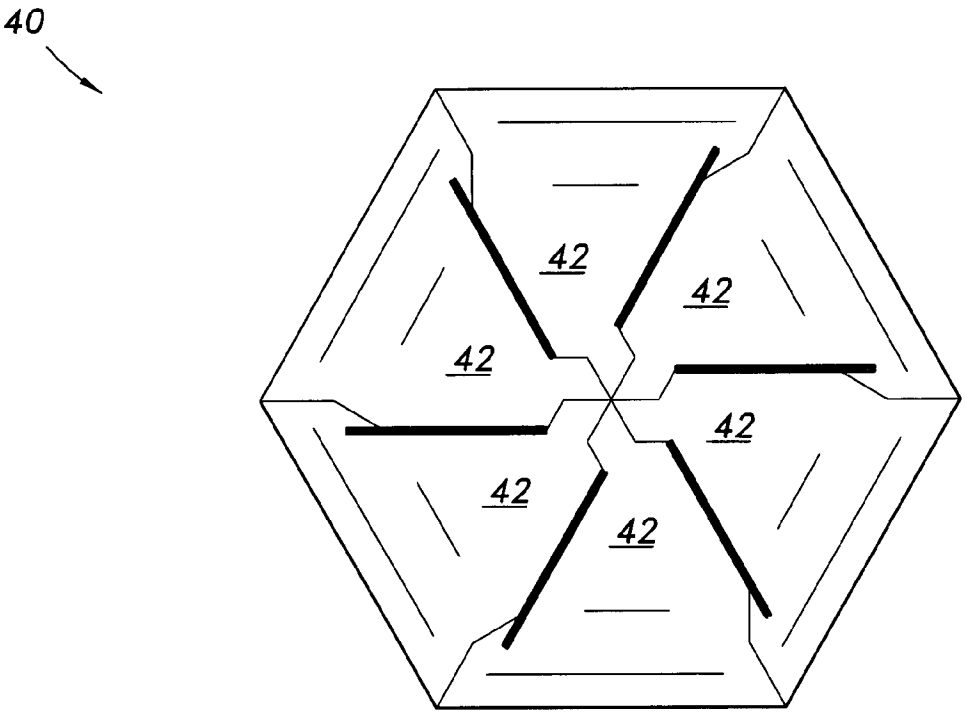
FIG. 4A is a top view of a base of the expansible amusement device according to the present invention.

The expansible amusement device 10 includes a pair of bases 40, each being substantially planar. As best shown in FIG. 4A, each base 40 includes a plurality of base members 42 joined together. Preferably, each base 40 is substantially hexagonal, although it should be understood that each base 40 may have any desired polygonal shape or size.

Figure 4B:
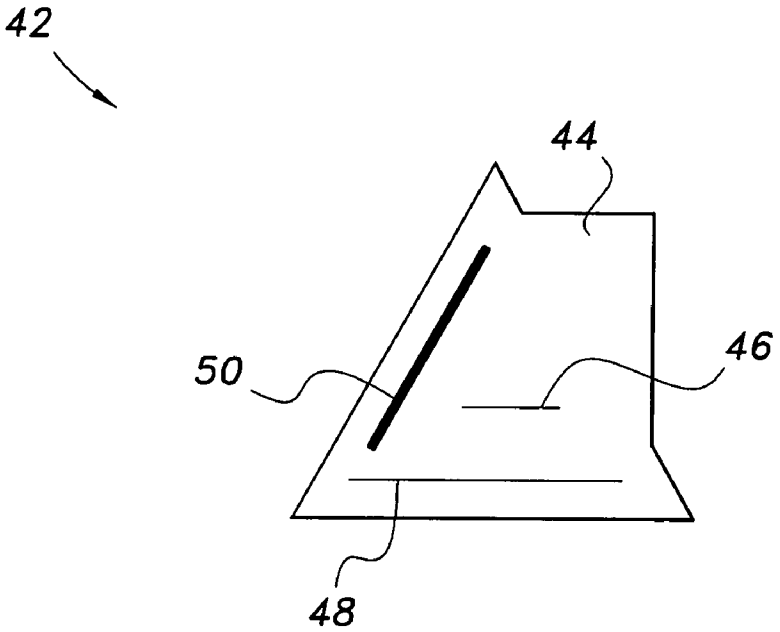
FIG. 4B is a top view of a base member of the base of FIG. 4A.
Figure 4C:
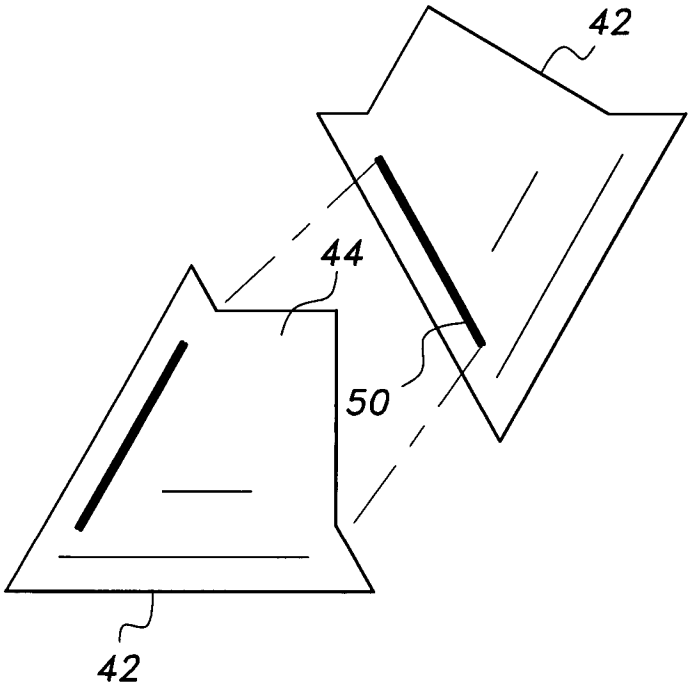
FIG. 4C is an exploded top view of a pair of the base members of FIG. 4B.
Figure 4D:
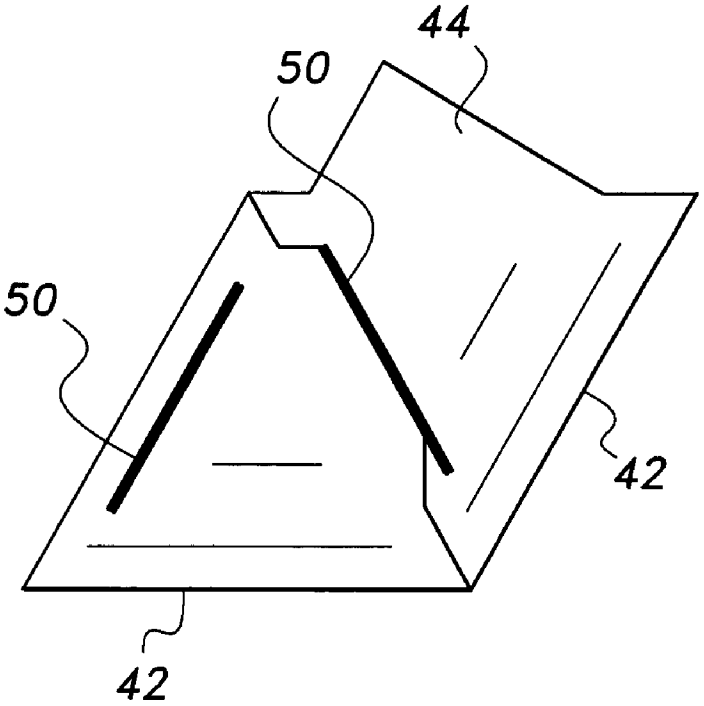
FIG. 4D is a top view of the pair of base members of FIG. 4C, shown after attachment to each other.
Figure 4E:
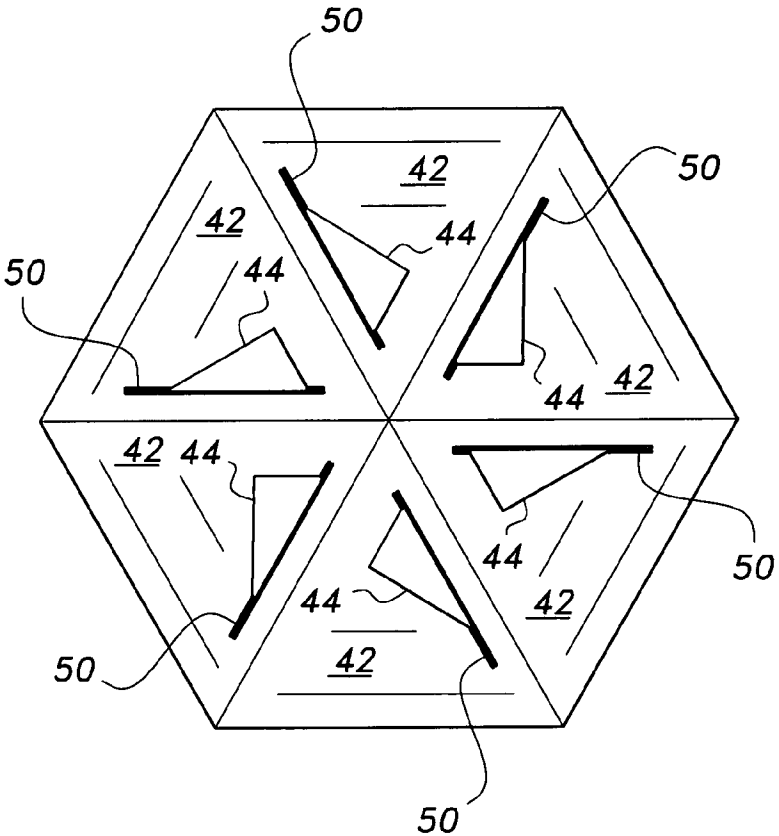
FIG. 4E is a bottom view of a base of the expansible amusement device according to the present invention.

FIG. 4B illustrates a single base member 42. Each base member 42 has a tab portion 44 and first, second and third slots 50, 48, 46, respectively, formed therethrough. FIGS. 4C and 4D illustrate a pair of base members 42 being joined together, with the tab portion 44 of one being received within a respective first slot 50 of the adjacent base member. FIG. 4E illustrates the bottom of the base 42 (with respect to the top view of FIG. 4A), showing the fully constructed base 40 with tabs 44 received through slots 50.

Figure 2A:
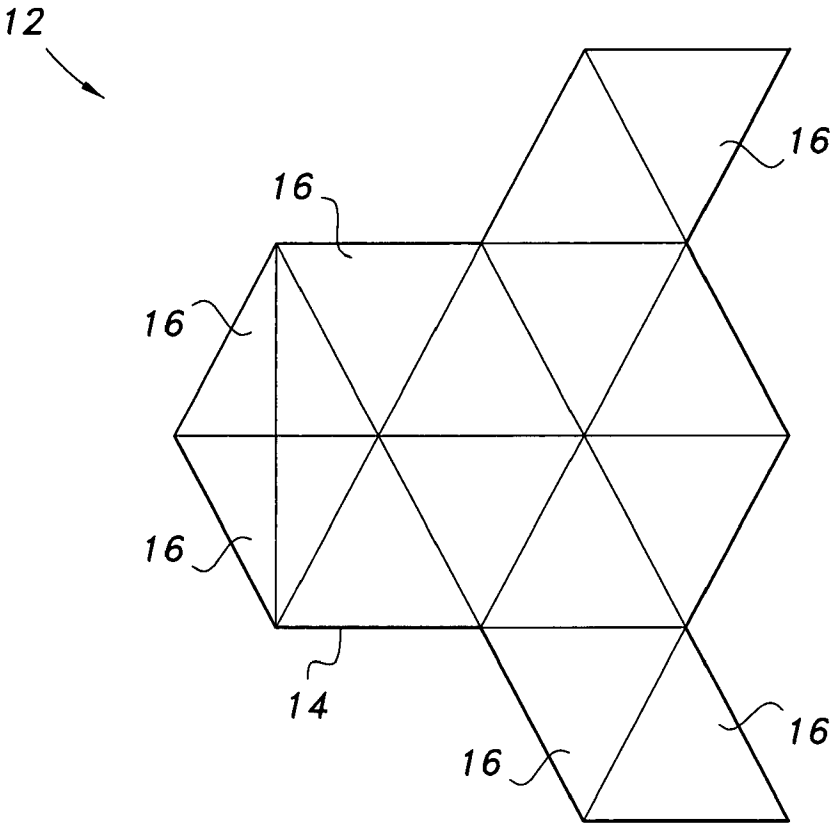
FIG. 2A is a plan view of a blank for an expanding module of the expansible amusement device according to the present invention.
Figure 3A:
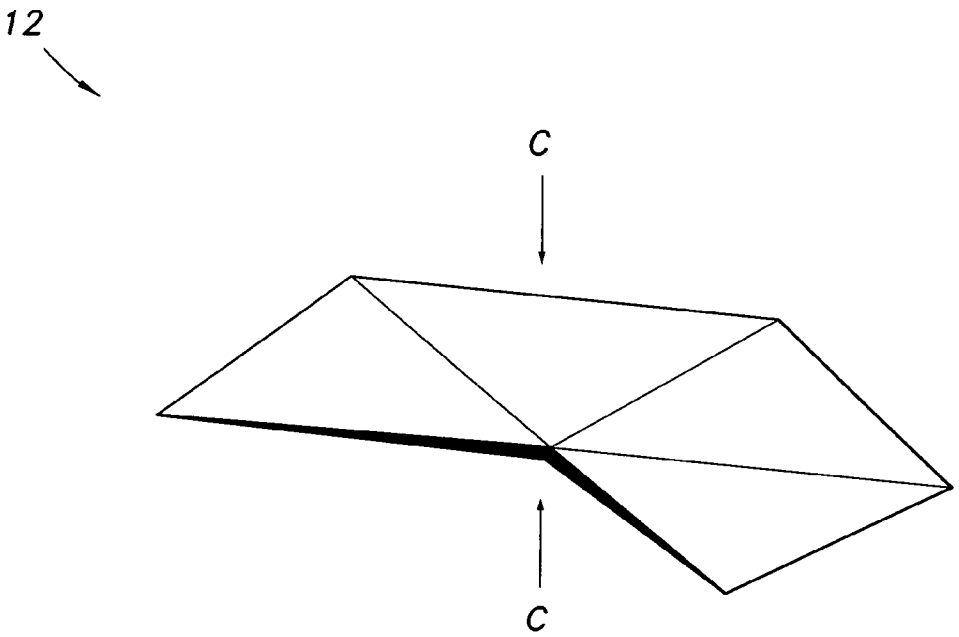
FIG. 3A is a perspective view of the expanding module of the expansible amusement device according to the present invention, shown in a compressed state.

A plurality of elastically expandable members 12 are further provided, with each elastically expandable member 12 also being substantially planar when in a compressed state (as best shown in FIG. 3A). As shown in FIG. 2A, each elastically expandable member 12 is preferably formed from a one-piece blank 14.

Figure 3B:
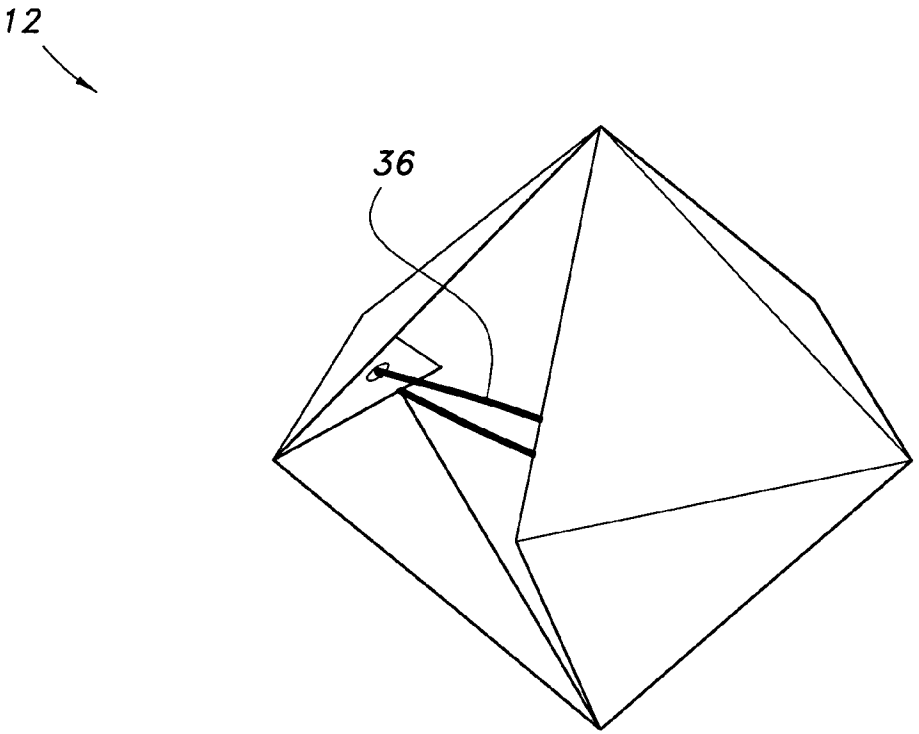
FIG. 3B is a perspective view of the expanding module of the expansible amusement device according to the present invention, shown in a partially decompressed state.
Figure 3C:
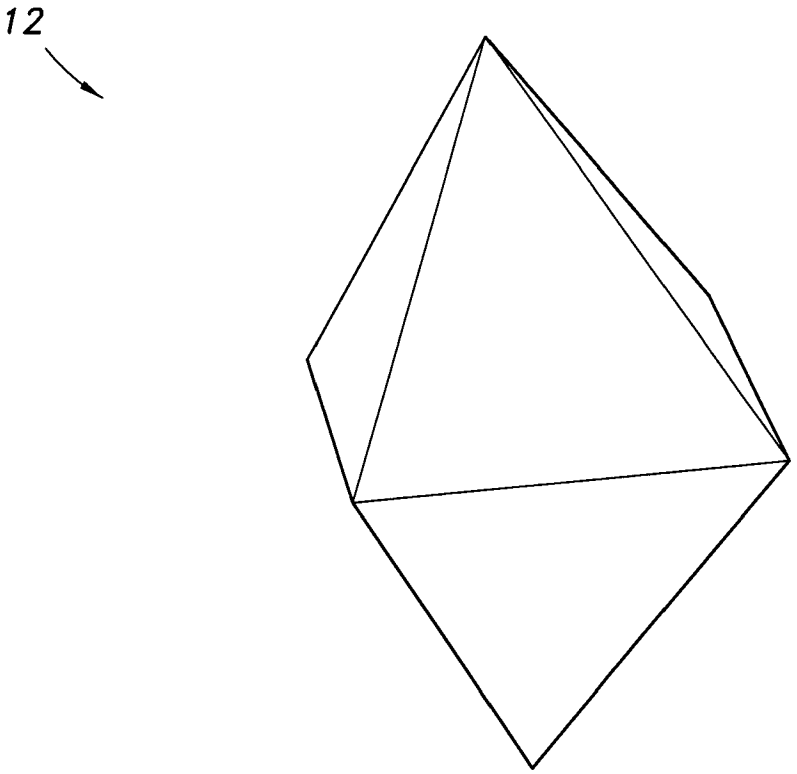
FIG. 3C is a perspective view of the expanding module of the expansible amusement device according to the present invention, shown in a fully deployed state.

Preferably, each elastically expandable member 12 has a regular polyhedral shape in the uncompressed state. Each elastically expandable member may be formed as a regular octahedron (as shown in FIGS. 3B and 3C), although it should be understood that other polyhedra, including non-regular polyhedra, are contemplated. In FIG. 2A, the one-piece blank 14 is divided into a plurality of equilateral triangles in order to form the octahedron of FIG. 3C.

Figure 2B:
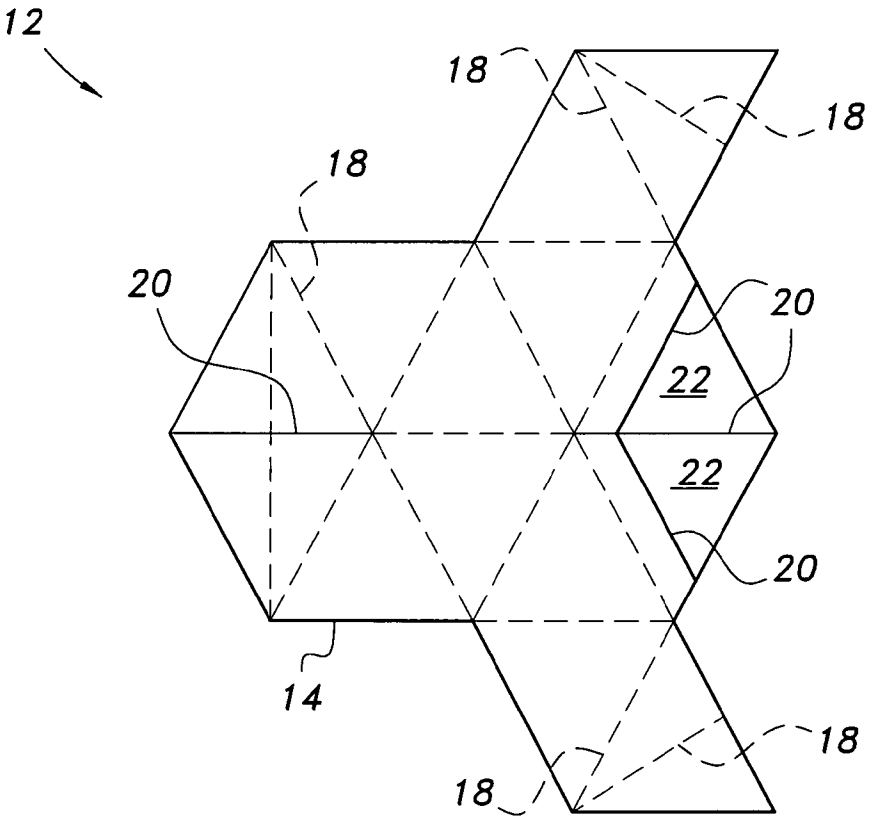
FIG. 2B is a plan view of the blank of FIG. 2A, with score and cut lines.
Figure 2C:
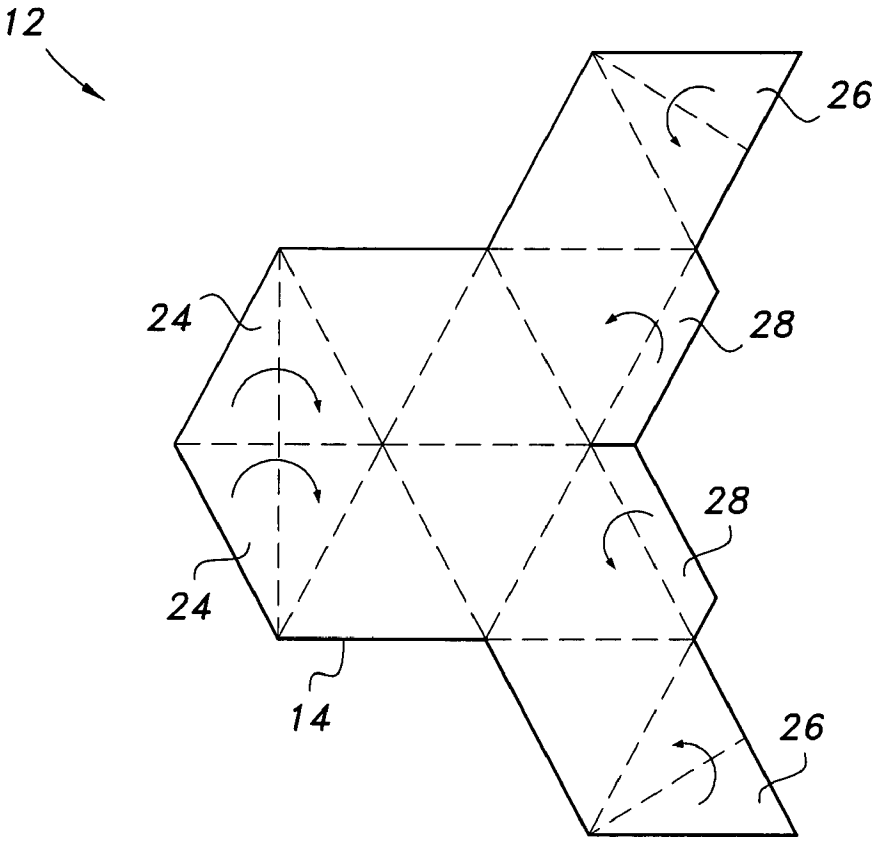
FIG. 2C is a plan view of the blank of FIG. 2A, illustrating initial folds in the formation of the expanding module.
Figure 2D:
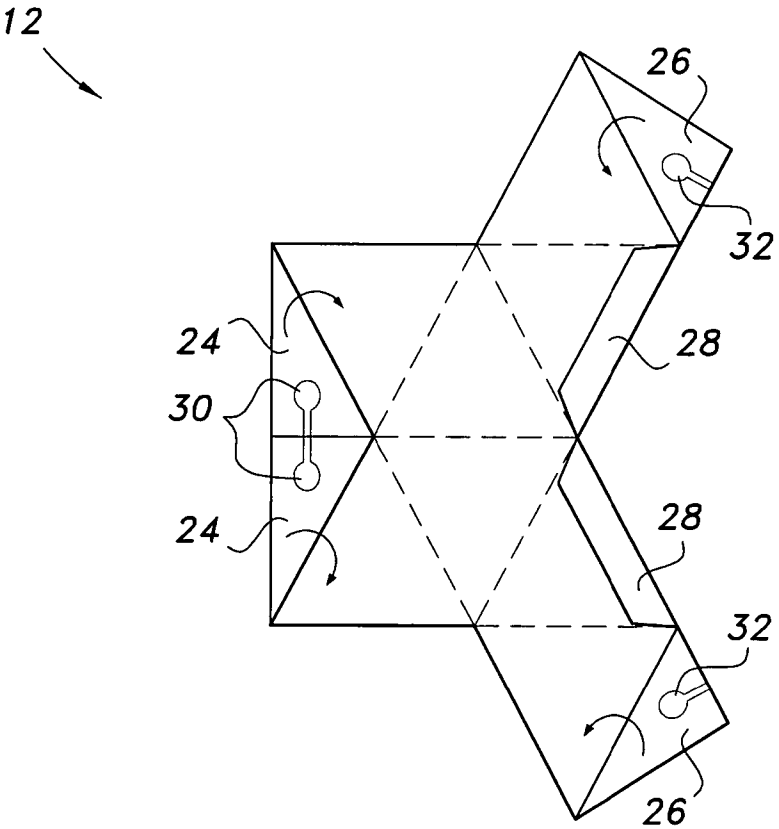
FIG. 2D is a plan view of the blank of FIG. 2A, illustrating further folds and anchor points for an elastic band in the formation of the expanding module.

In FIG. 2B, the blank 14 is scored along the dashed lines 18 and is cut along the three solid cut lines 20. Portions 22 are removed following cutting, resulting in the blank of FIG. 2C. The directional arrows in FIG. 2C illustrate folding about the scored fold lines, in order to form folded, reinforced portions 24 and 26, as well as tabs 28. Reinforced portions 24, 26 may be secured through the use of adhesive or any other suitable means for retention. Following folding, openings 30, which may have a substantially keyhole shape, as shown in FIG. 2D, are formed through reinforced portions 24. Similar openings 32 are formed through reinforced portions 26, as shown in FIG. 2D.

Figure 2E:
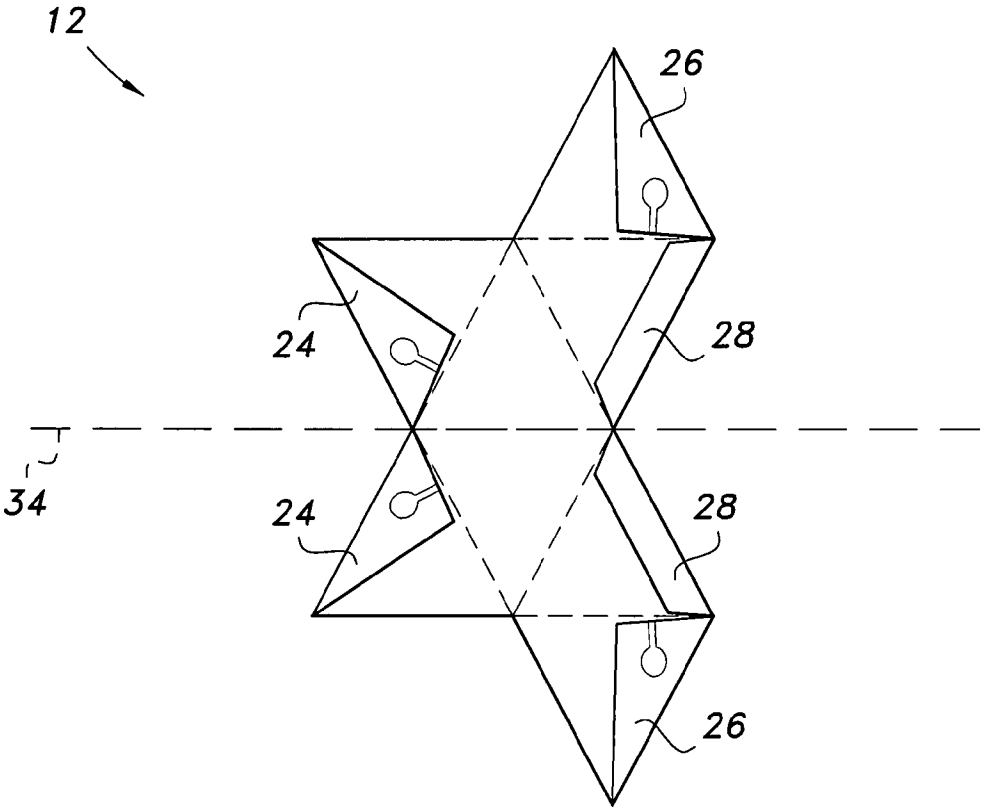
FIG. 2E is a plan view of the blank of FIG. 2A, illustrating further folds in the formation of the expanding module.
Figure 2F:
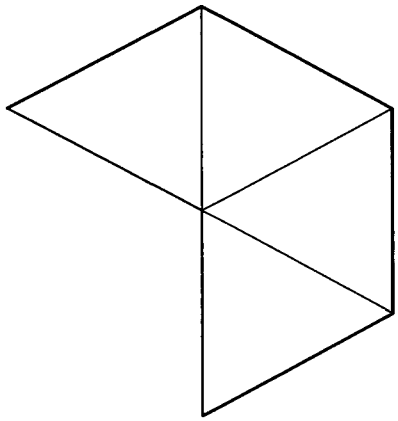
FIG. 2F is a top view of the expanding module of the expansible amusement device according to the present invention.
Figure 2G:
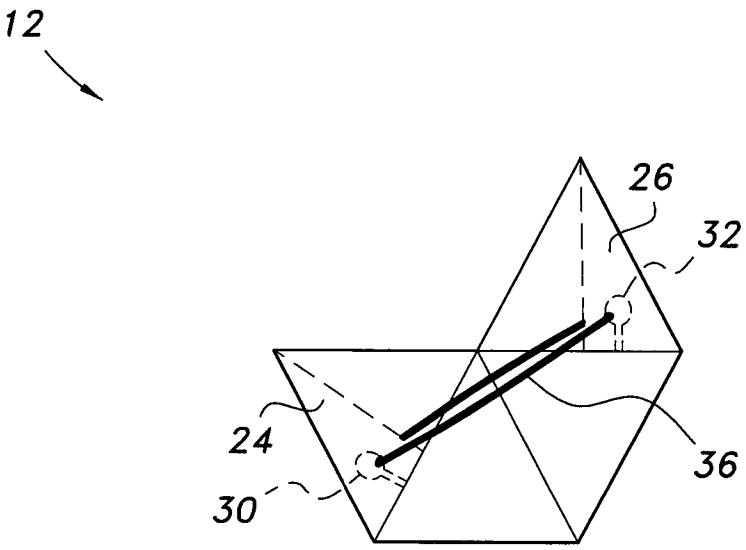
FIG. 2G is a top, partially cut-away view of the expanding module of the expansible amusement device according to the present invention.

The directional arrows of FIG. 2D illustrate the subsequent folding of portions 24 and 26, resulting in the shape of FIG. 2E. The dashed line 34 represents a fold line along the horizontal, center axis of the blank 14 and, after folding and securing together reinforced portions 24, 26, and tabs 28, respectively, the resultant member is shown in FIG. 2F. FIG. 2F represents a front view of member 12 and FIG. 2G shows a top, partially cut-away or transparent view thereof, where an elastic band 36 has been secured through, and extends between, the openings 30 and 32 in reinforced portions 24, 26, respectively.

In FIG. 3A, the elastically expandable member 12 is held in a compressed state by compressive forces C and maintains a substantially planar shape. When the compressive forces C are removed, the elastic band 36 draws the opposed edges of the elastically expandable member 12 towards one another, as shown in FIG. 3B, resulting in the fully deployed octahedron shown in FIG. 3C. Release of the tension in elastic band 36 generates acoustic effects, particularly in the form of a snapping sound when the opposed edges of the expandable member 12 are drawn together.

Figure 13:
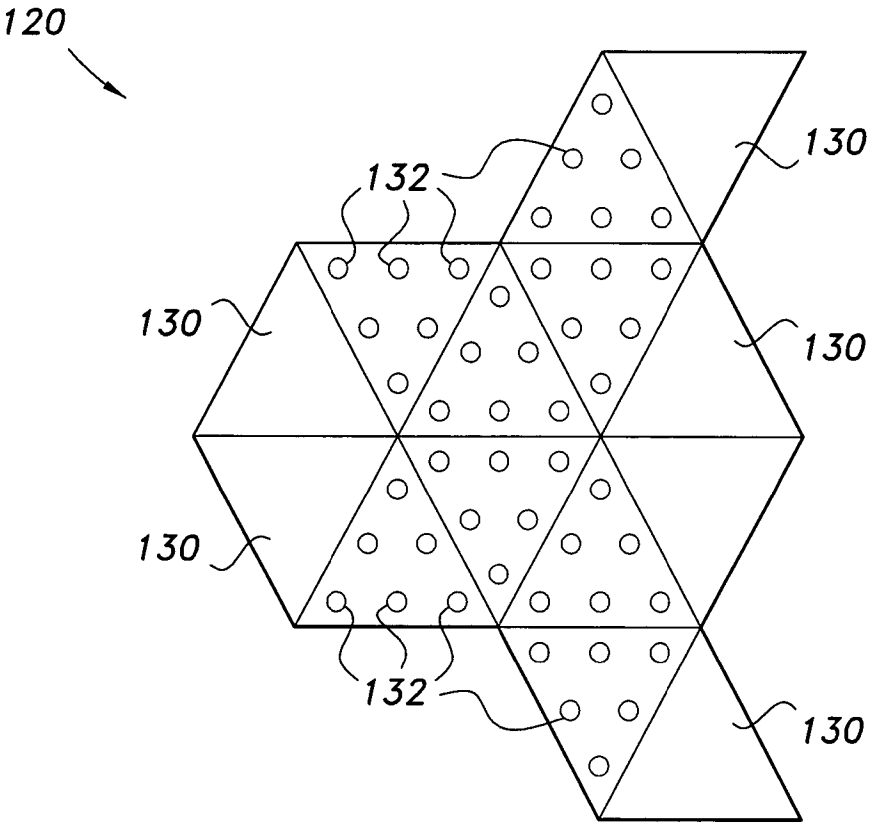
FIG. 13 is a plan view of a blank for an alternative expanding module of an expansible amusement device according to the present invention.

In the alternative embodiment of FIG. 13, blank 14 has been replaced by blank 120. Blank 120 is divided into a plurality of equilateral triangles 130, similar to blank 14, but has a plurality of air flow apertures 132 formed therethrough. Air flow apertures 132 reduce the weight of the blank and further increase the rate of expansion thereof due to lowered air resistance.

Figure 7A:
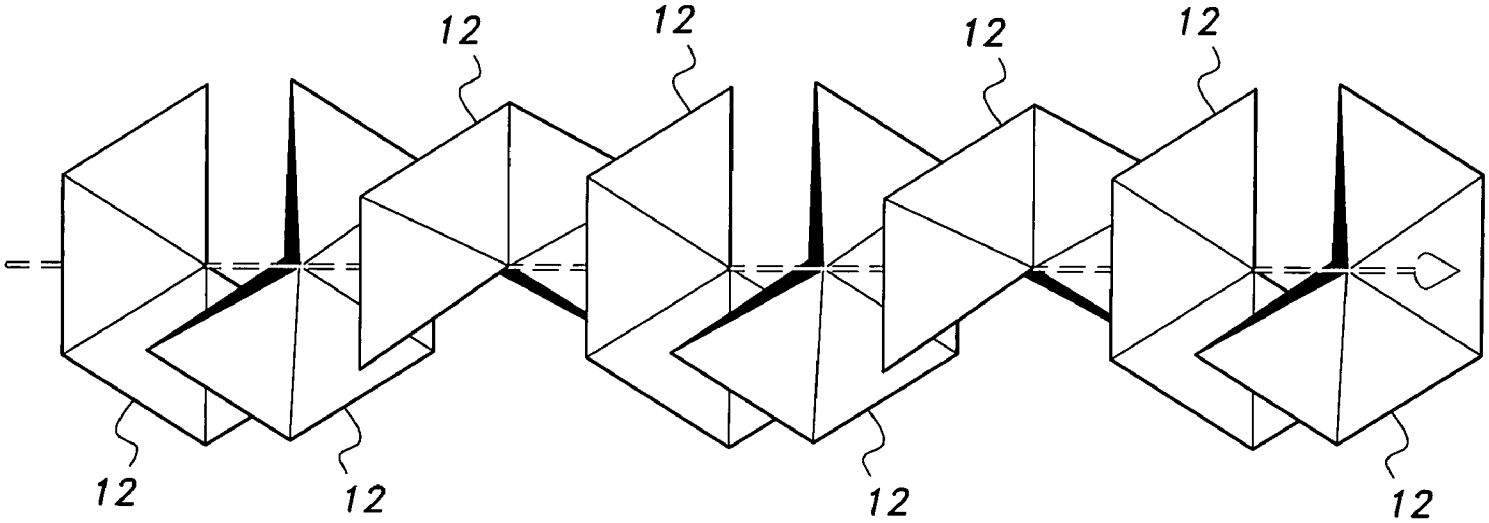
FIG. 7A is an exploded perspective view of a plurality of compressed expanding modules of the expansible amusement device according to the present invention.
Figure 7B:
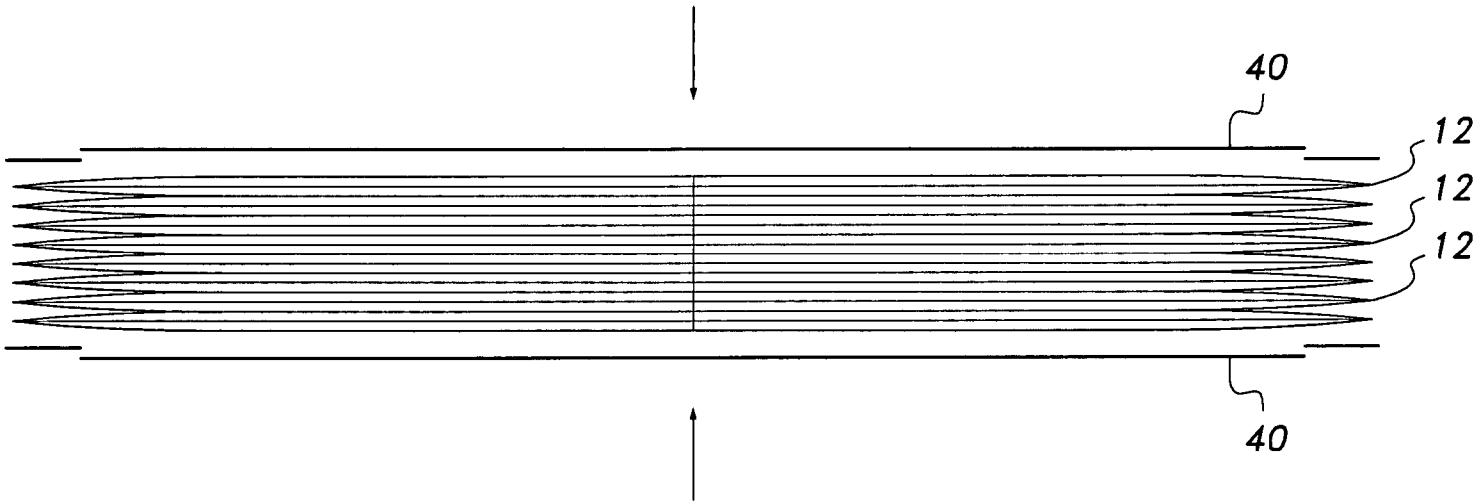
FIG. 7B is a side view of the plurality of compressed expanding modules of FIG. 7A, shown sandwiched between a pair of bases.
Figure 7C:
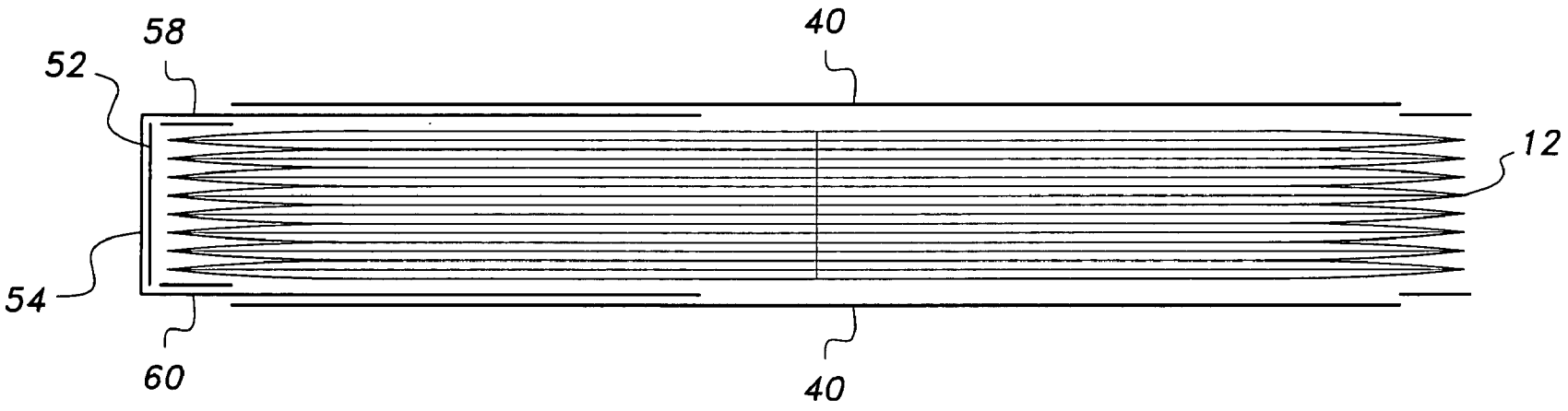
FIG. 7C is a side view of a partially assembled expansible amusement device according to the present invention.

As shown in FIGS. 7A and 7B, the plurality of elastically expandable members 12 are stacked and sandwiched between the pair of bases 40 when the expansible amusement device 10 is in a compressed configuration. As shown in FIG. 7A, the members 12 are preferably positioned approximately 240° about the dashed central axis with respect to adjacent ones thereof.

Figure 9A:
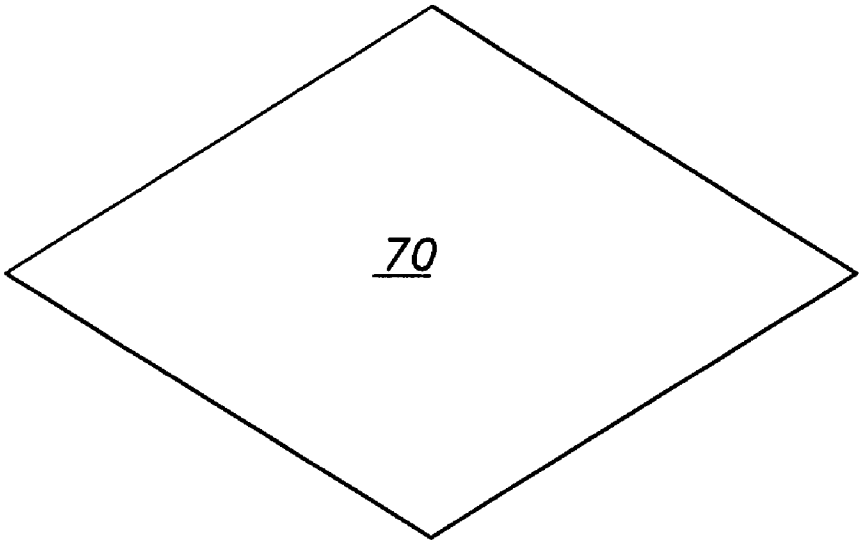
FIG. 9A is a plan view of a first type of confetti used with the expansible amusement device according to the present invention.
Figure 9B:
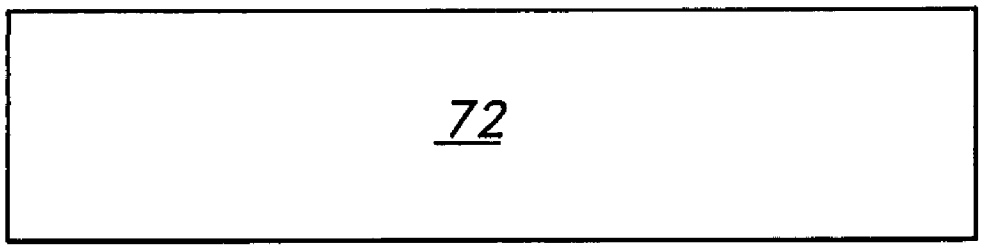
FIG. 9B is a plan view of a second type of confetti used with the expansible amusement device according to the present invention.
Figure 9C:
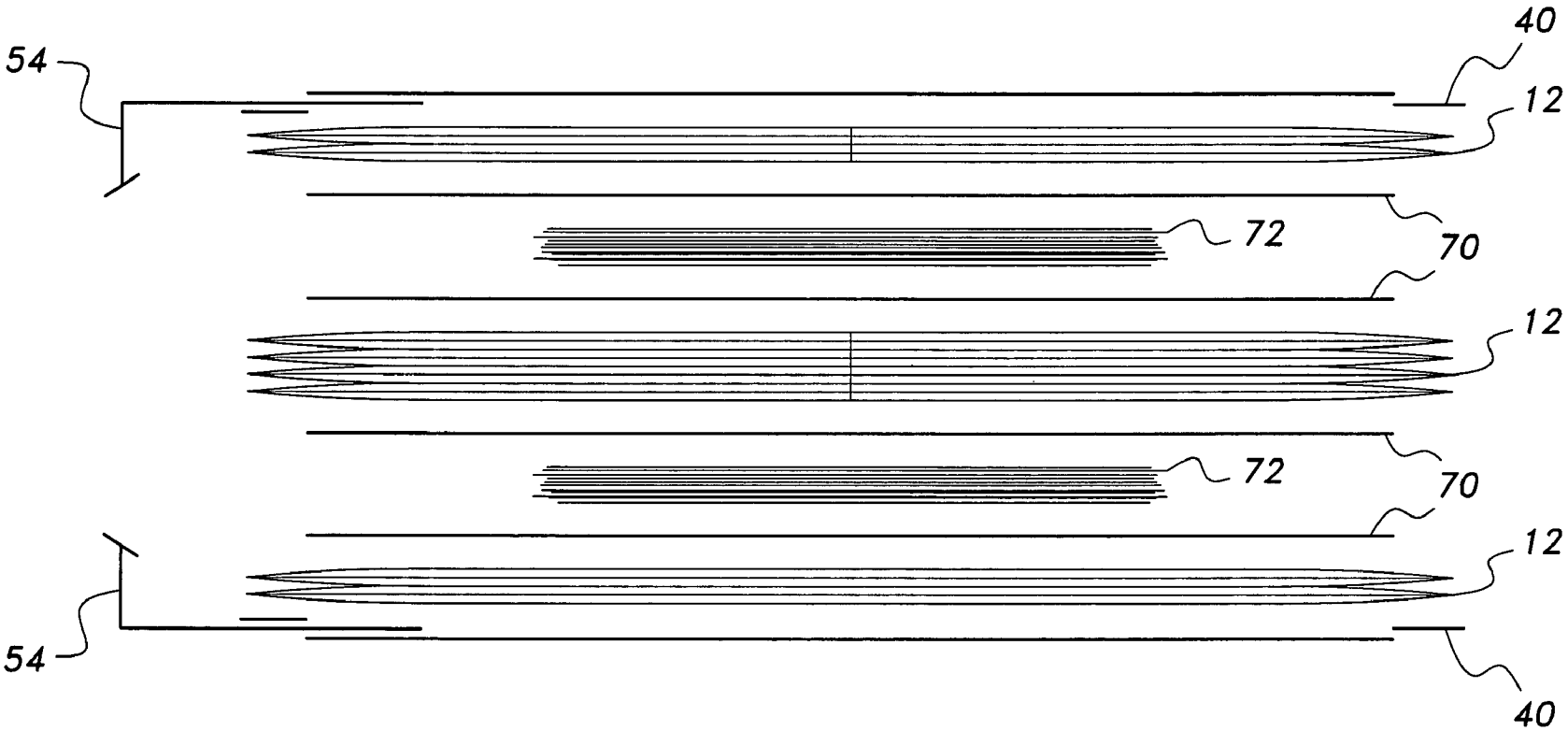
FIG. 9C is a partial side view of a partially assembled expansible amusement device according to the present invention.

As shown in FIG. 9C, a plurality of confetti strips are positioned between adjacent ones of the plurality of elastically expandable members 12 when the expansible amusement device 10 is in the compressed configuration. Any desired shape or size of confetti may be utilized. In FIGS. 9A and 9B, two separate types of exemplary confetti are shown, with confetti strip 70 being substantially diamond-shaped and confetti strip 72 being substantially rectangular. As shown in FIG. 9C, confetti strips 70 and 72 may be alternated, stacked, and layered between the expandable members 12.

Figure 5A:
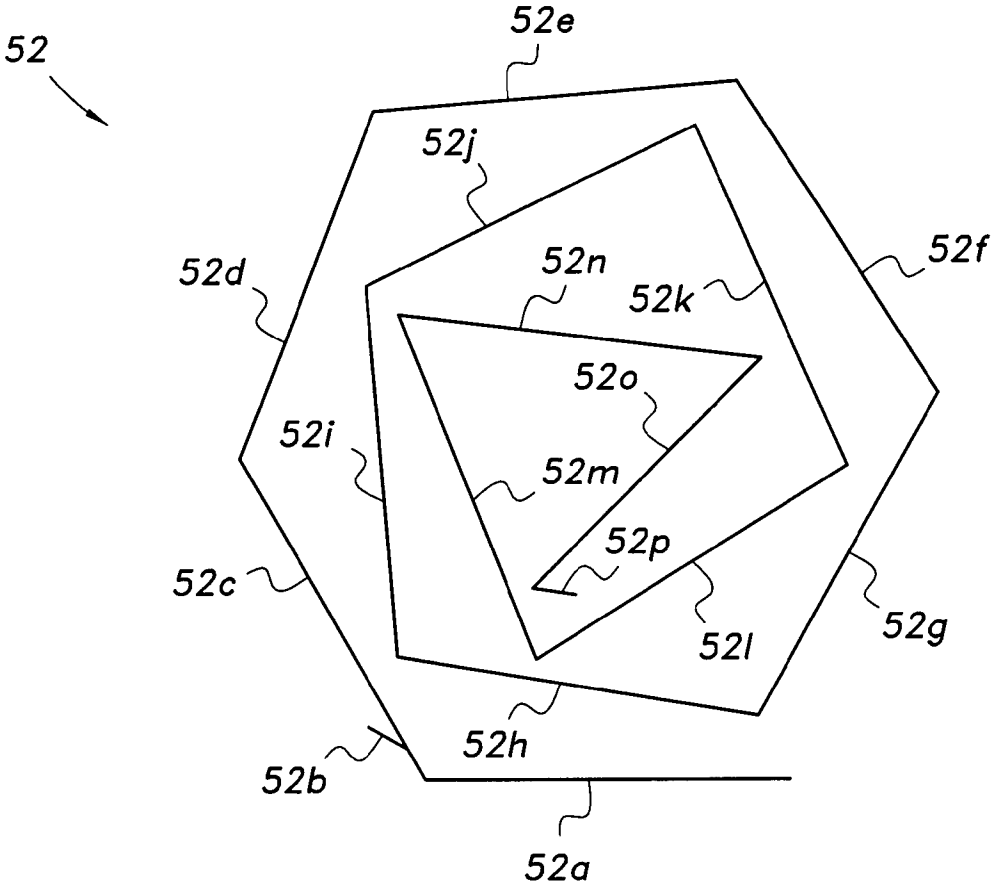
FIG. 5A illustrates a top view of a partially folded launch strip of the expansible amusement device according to the present invention.
Figure 5B:
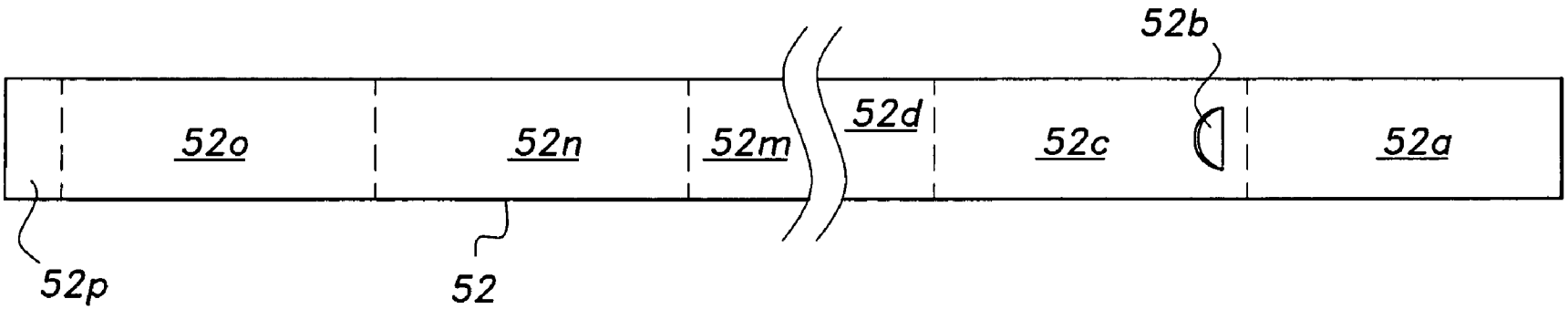
FIG. 5B is an elevation view of the launch strip of the expansible amusement device according to the present invention.
Figure 6A:
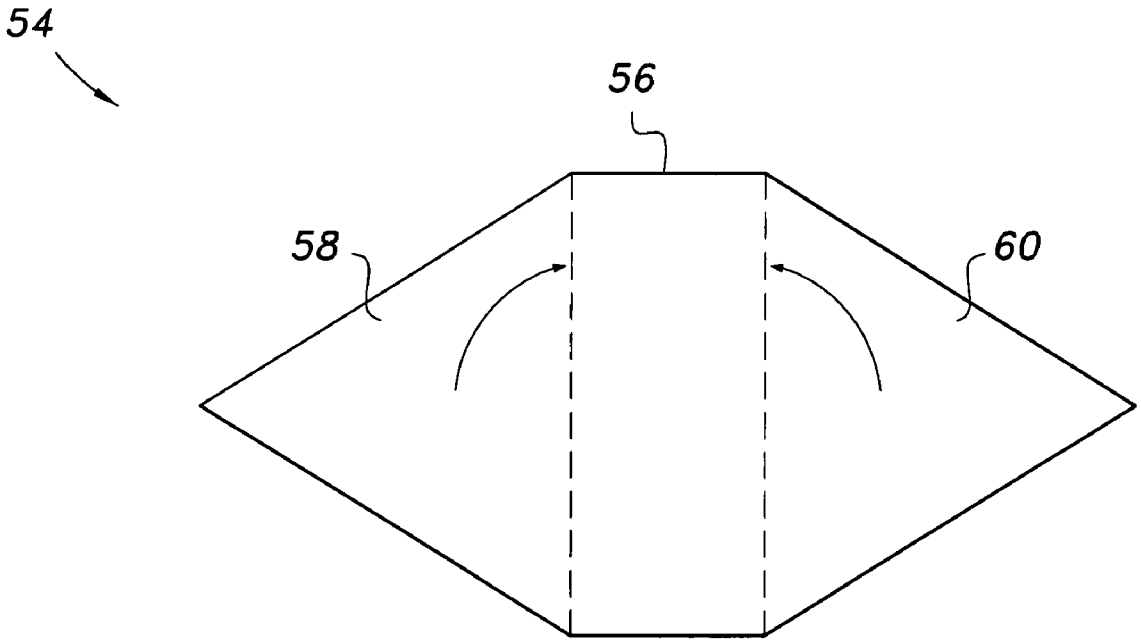
FIG. 6A is a plan view of a first retaining member of the expansible amusement device according to the present invention.
Figure 6B:
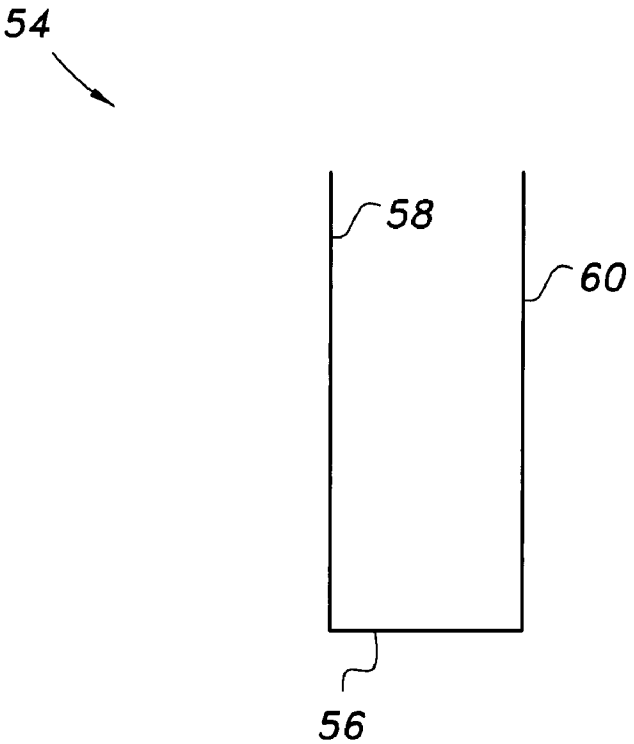
FIG. 6B is a side view of the first retaining member of FIG. 6A after folding.
Figure 6C:
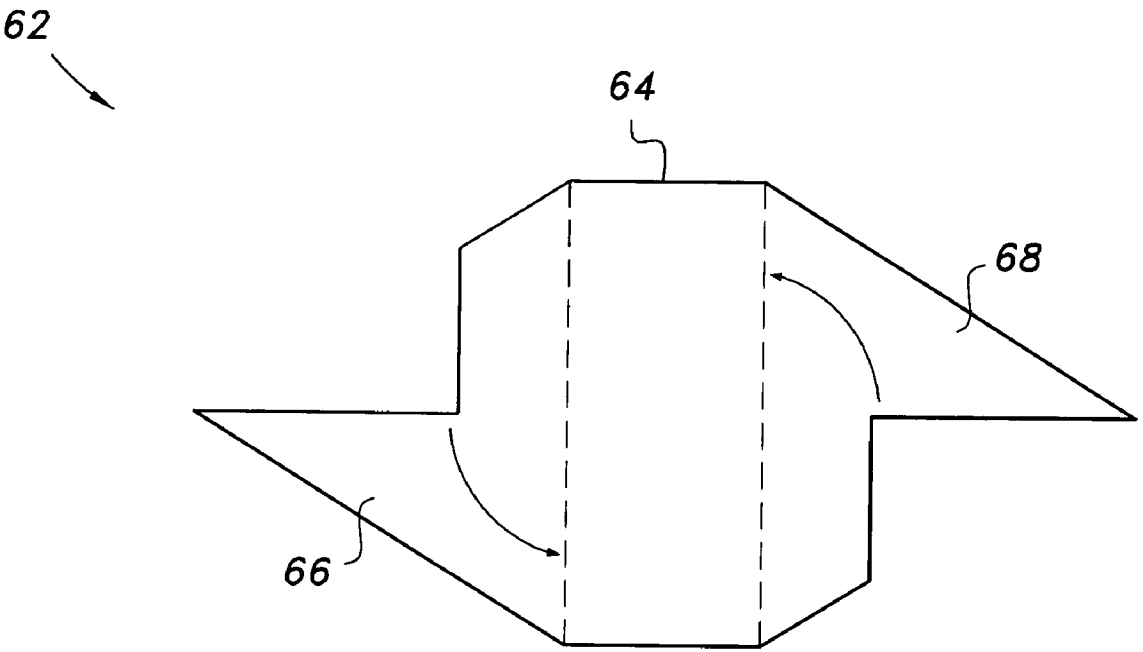
FIG. 6C is a plan view of a second retaining member of the expansible amusement device according to the present invention.
Figure 6D:
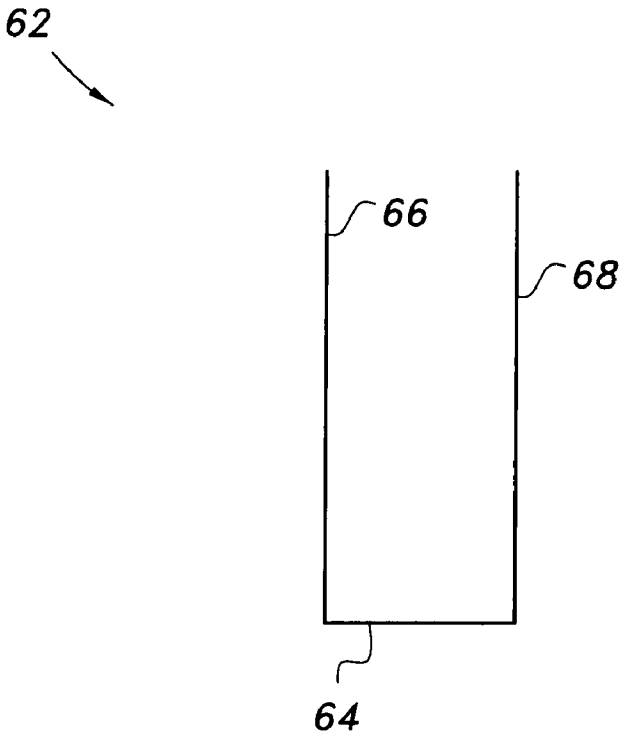
FIG. 6D is a side view of the second retaining member of FIG. 6C after folding.

As shown in FIGS. 5A and 5B, a deployment strip 52 is further provided. The deployment strip 52 is divided, as shown, into segments 52*a*, 52*c*, 52*d*, 52*e*, 52*f*, 52*g*, 52*h*, 52*i*, 52*j*, 52*k*, 52*l*, 52*m*, 52*n*, 52*o* and 52*p*, along with a separate, open tab 52*b* being formed in segment 52*c*, as shown. Further, as shown in FIG. 6A, a plurality of first retaining members 54 are provided, with each first retaining member 54 being folded to have, as shown in FIG. 6B, a pair of side portions or retaining tabs 58, 60, and a central portion 56. Preferably, each side portion 58, 60 has a substantially triangular shape, as shown. A secondary retaining member 62 is further provided, as shown in FIGS. 6C and 6D, with the secondary retaining member 62 also being folded to form a pair of side portions or retaining tabs 66, 68 and a central portion 64.

Figure 8A:
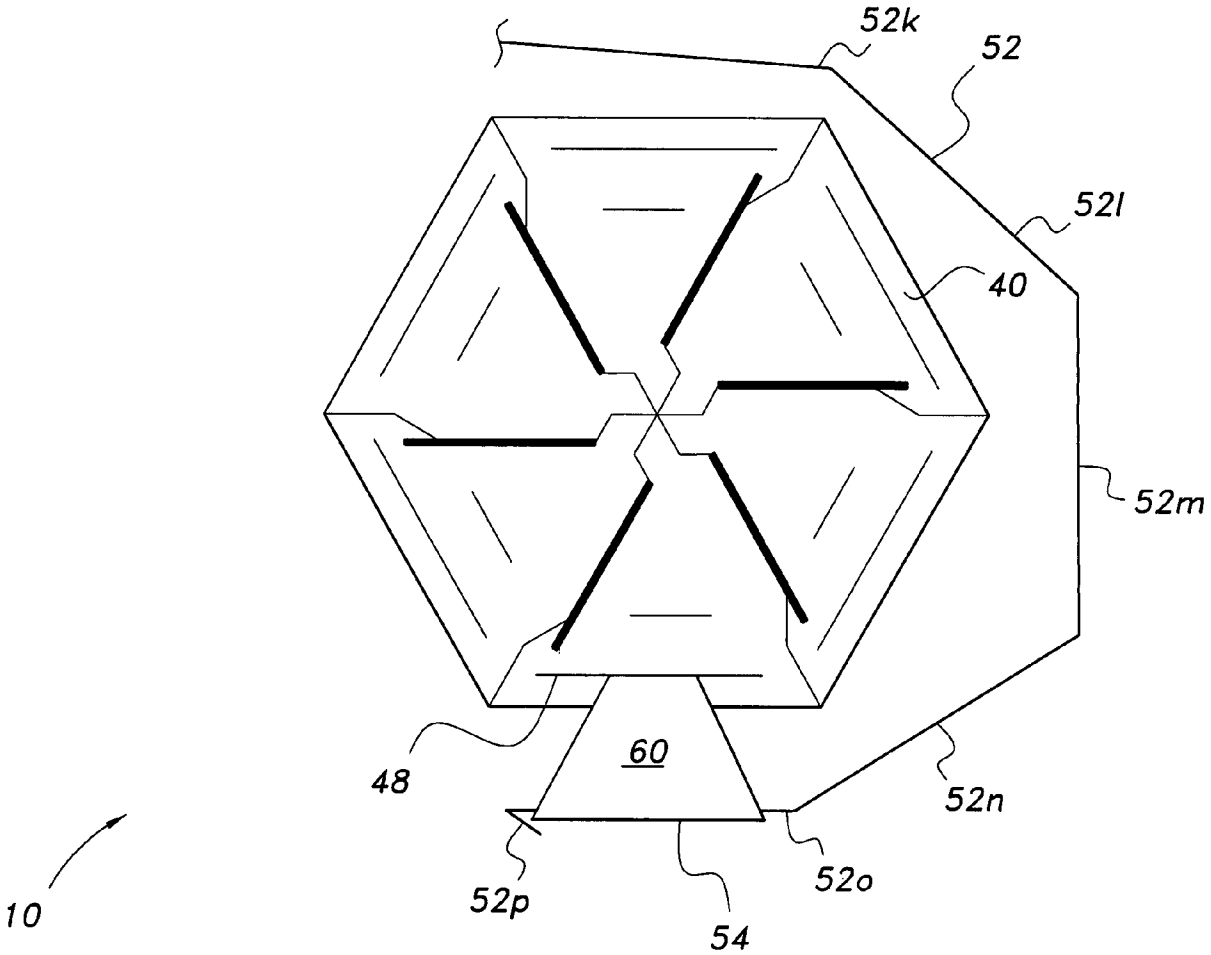
FIG. 8A is a top view of a partially assembled expansible amusement device according to the present invention.

As shown in FIG. 8A, the deployment strip 52 is peripherally wrapped about the pair of bases 40 and the plurality of elastically expandable members 12 when the expansible amusement device 10 is in the compressed configuration. As shown in FIG. 8A, portion 52*o* is secured within a first retaining member 54 as the tabs 58, 60 thereof are inserted through second slots 48 formed through one of the base members 42 of the upper base 40 and a corresponding base member 42 of the lower base 40. Portion 52*p* is bent to form a hook, thus securing the fixed end of the deployment strip 52.

Figure 8B:
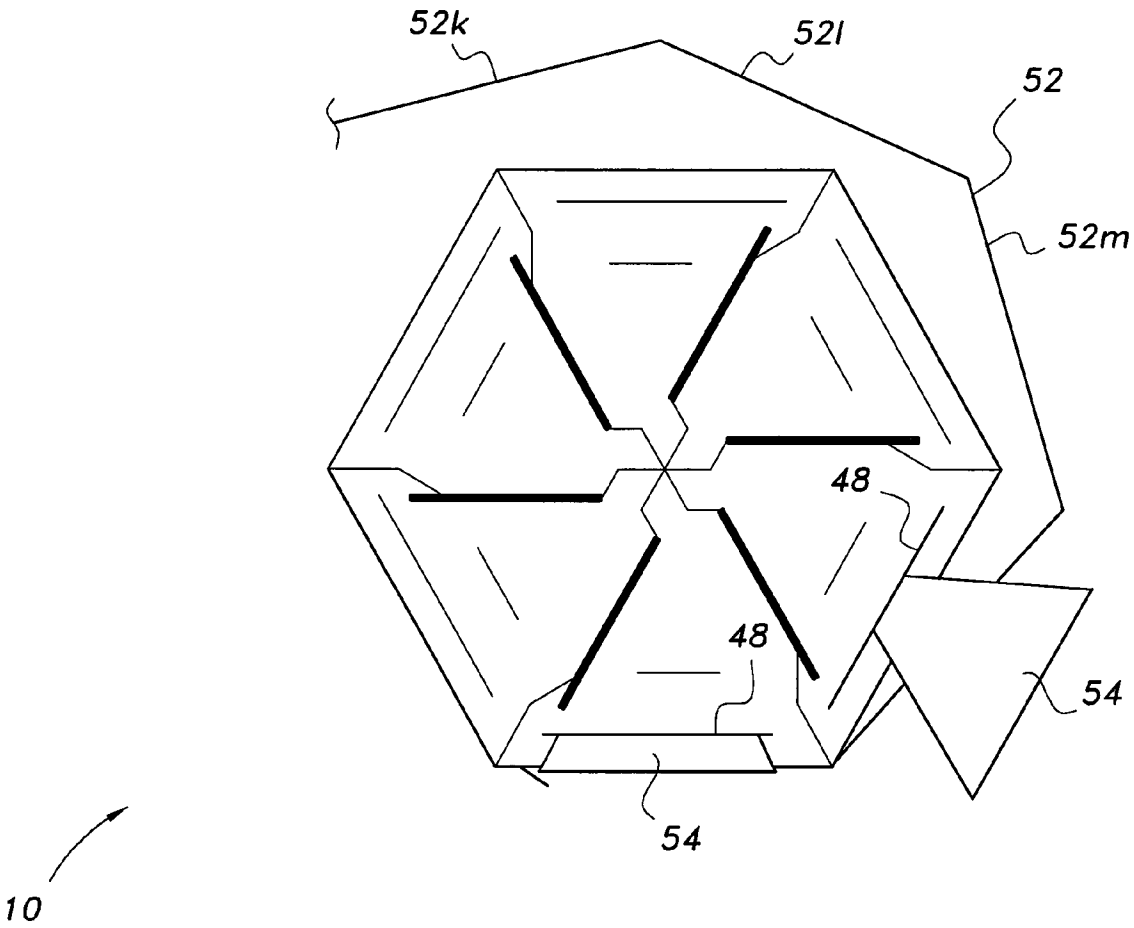
FIG. 8B is a top view of the partially assembled expansible amusement device of FIG. 8A, showing a further step in the assembly process.
Figure 8C:
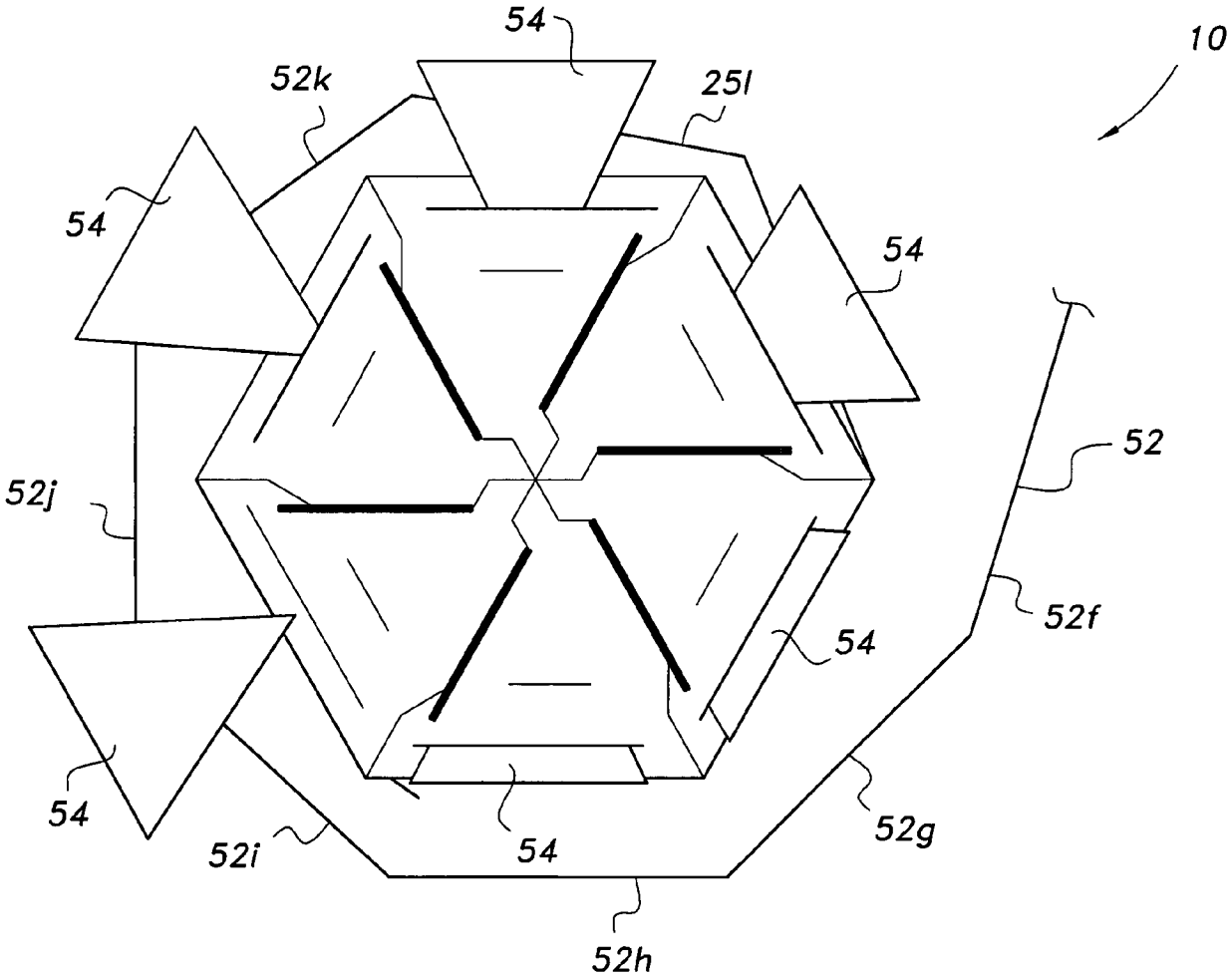
FIG. 8C is a top view of the partially assembled expansible amusement device of FIGS. 8A and 8B, showing further steps in the assembly process.
Figure 8D:
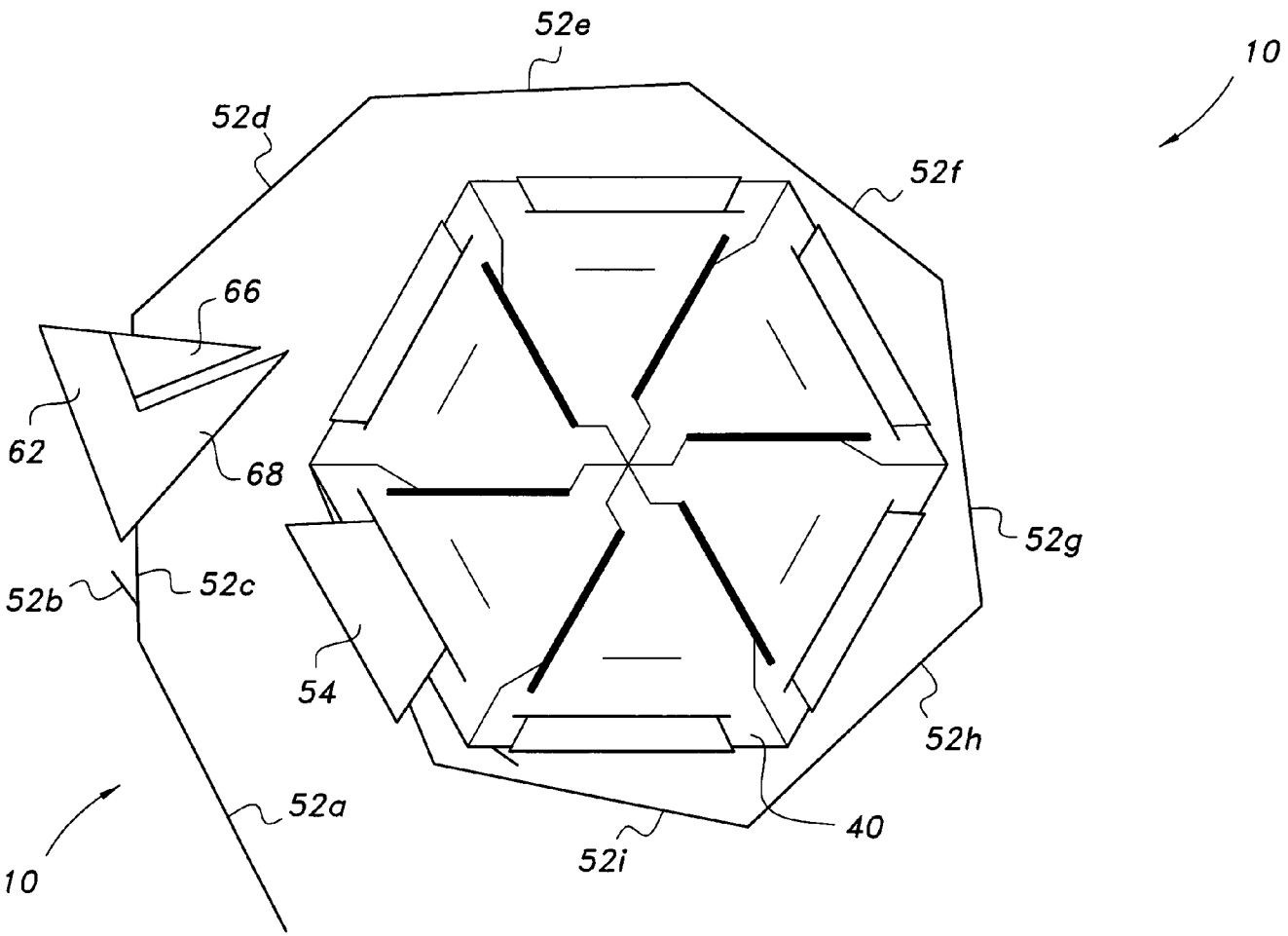
FIG. 8D is a top view of the partially assembled expansible amusement device of FIGS. 8A, 8B, and 8C, showing further steps in the assembly process.
Figure 8E:
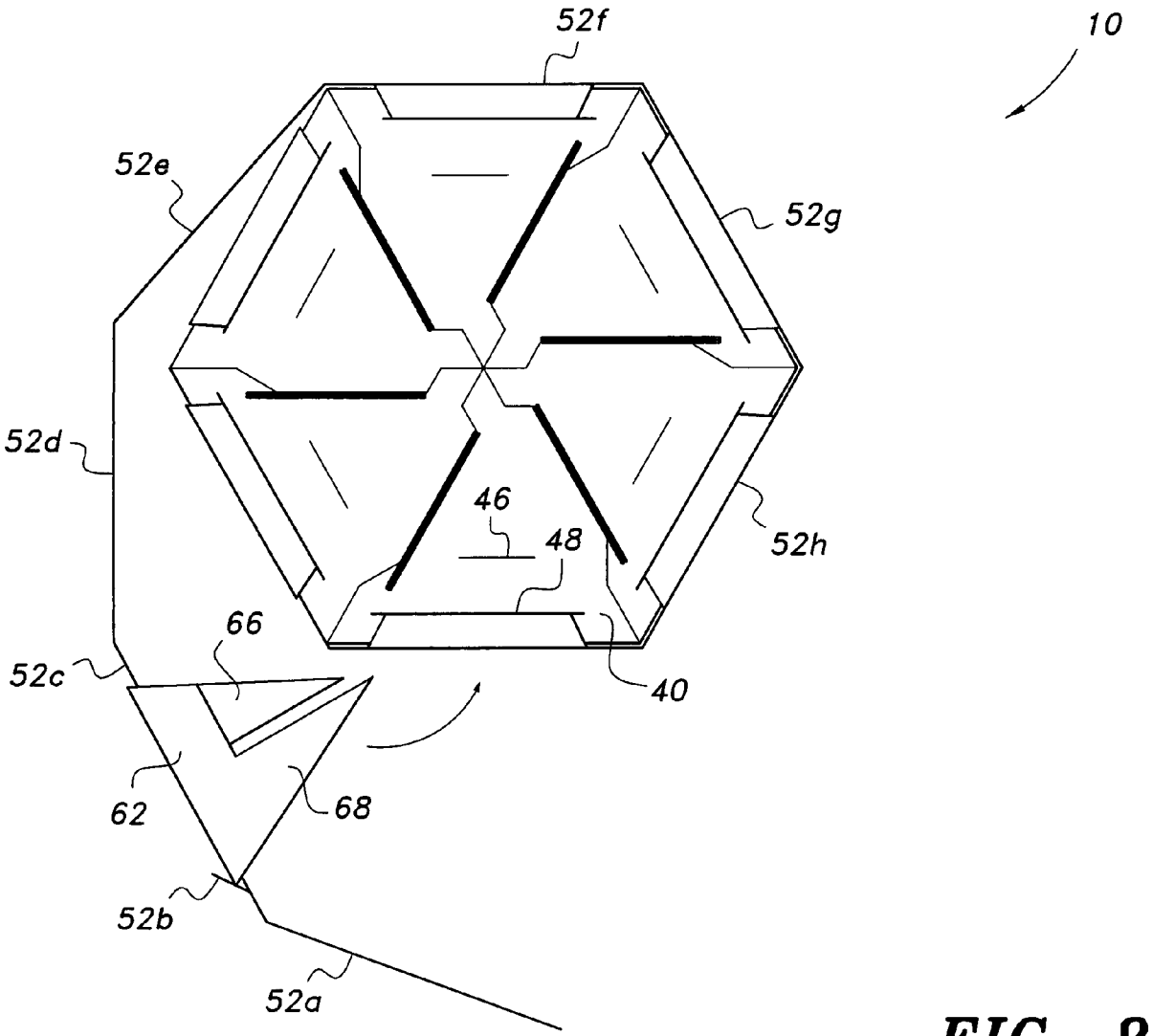
FIG. 8E is a top view of the partially assembled expansible amusement device of FIGS. 8A-8D, showing further steps in the assembly process.
Figure 8F:
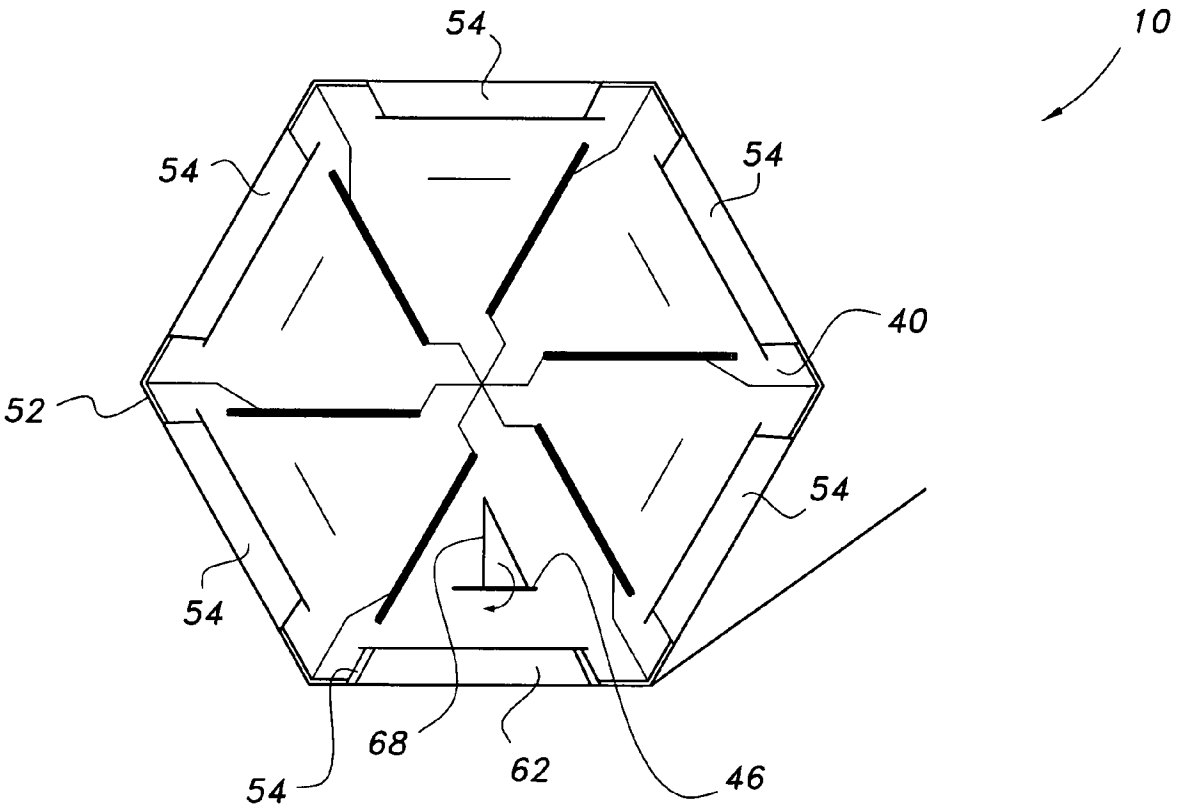
FIG. 8F is a top attachment view of the assembled expansible amusement device according to the present invention.

As shown in FIGS. 8B and 8C, the deployment strip 52 is wound about the device 10 and secured thereto via a plurality of retaining members 54, each being secured to a corresponding pair of upper and lower base members 42. As shown in FIGS. 8D and 8E, the secondary retaining member 62 receives segment 52*c* (and is held by tab portion 52*b*) with the retaining tabs 66, 68 thereof being received within a corresponding pair of third slots 46. In FIGS. 8E and 8F, the upper tab 68 is inserted through slot 48, passing under the respective base member, and then through slot 46, to be exposed, as in FIG. 8F. As indicated by the directional arrow in FIG. 8F, tab 68 is then folded over, thus locking the retaining member 62 in place. When the device 10 is ready to be deployed, the user unfolds the tabs 66, 68 (tab 66 is similarly inserted and folded on the underside of the device 10), thus setting or unlocking the device for deployment. The locking of retaining member 62 in place prevents premature disengagement of deployment strip 52. Tab portion 52*b* prevents slippage and unraveling of deployment strip 52 once secondary retaining member 62 is secured in place. As shown in FIGS. 8E and 8F, segment 52*a* projects outwardly, forming a free end of deployment strip 52 after the deployment strip has been secured to device 10 via the plurality of first retaining members 54 and the secondary retaining member 62. It should be understood that segment 52*a* is shown for exemplary purposes only, and that the angular projection in particular is only shown for illustrative purposes; i.e., the segment 52*a* could, for example, be pressed flush against the remainder of the strip. Segment 52*a* is a free end which is used, as described below, in the deployment of device 10. Alternatively, secondary retaining member 62 may be replaced by any suitable releasable attachment, such as a weak adhesive or connection of tab portion 52*b* with a corresponding slot formed through the deployment strip 52, or suitable combinations thereof.

Figure 14A:
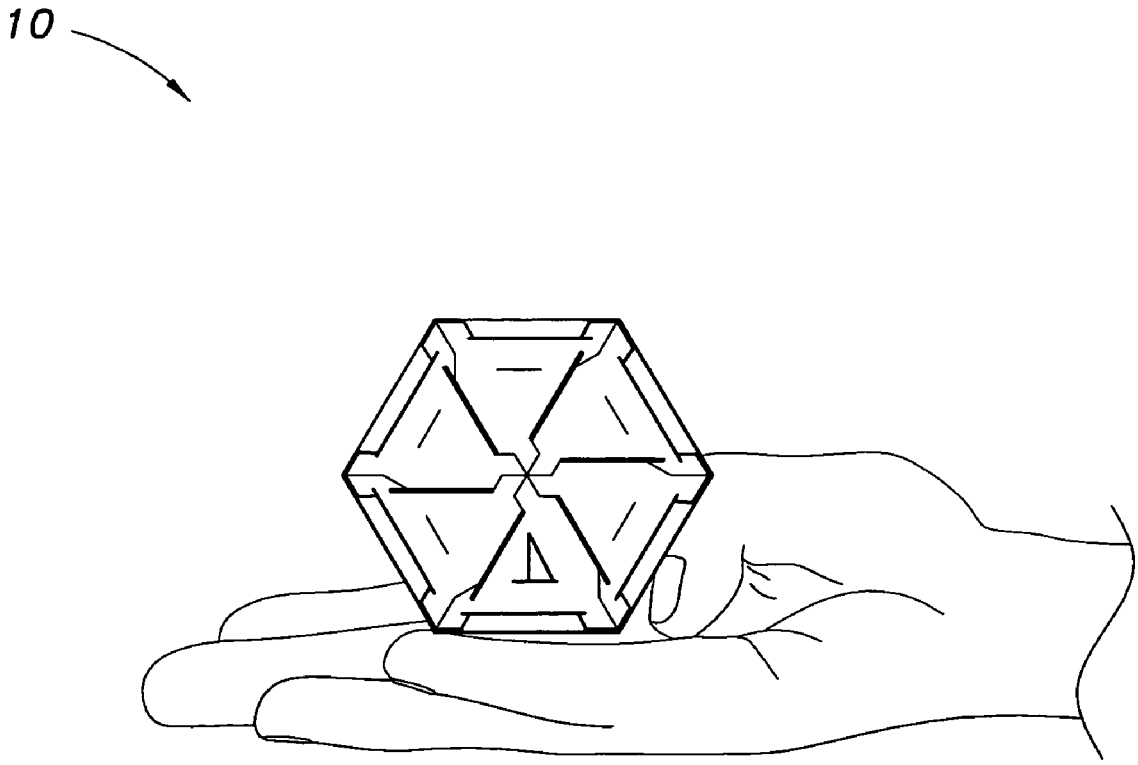
FIGS. 14A, 14B, 14C, and 14D are environmental side views illustrating deployment steps in the course of using an expansible amusement device according to the present invention.
Figure 14B:
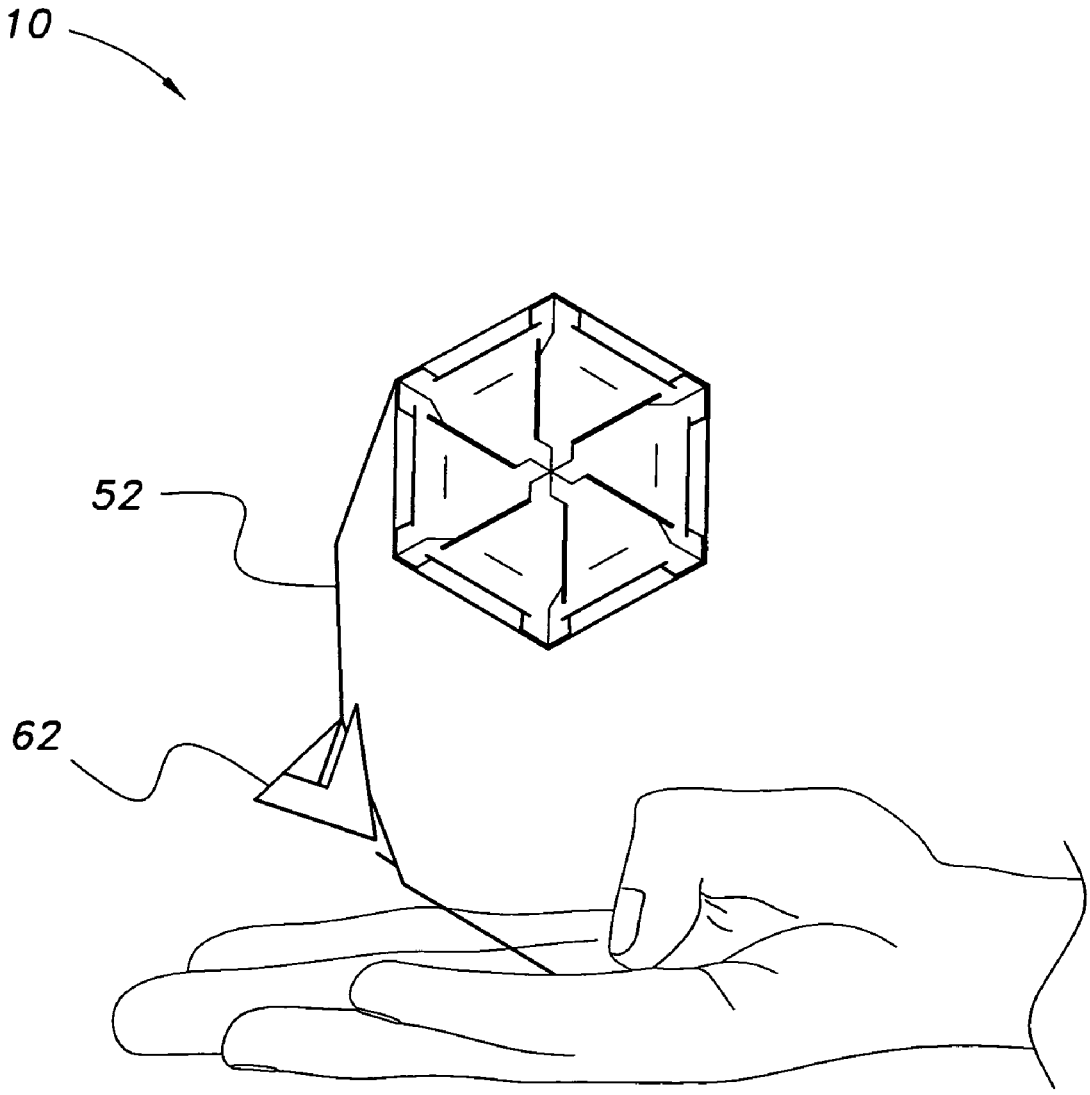
Figure 14C:
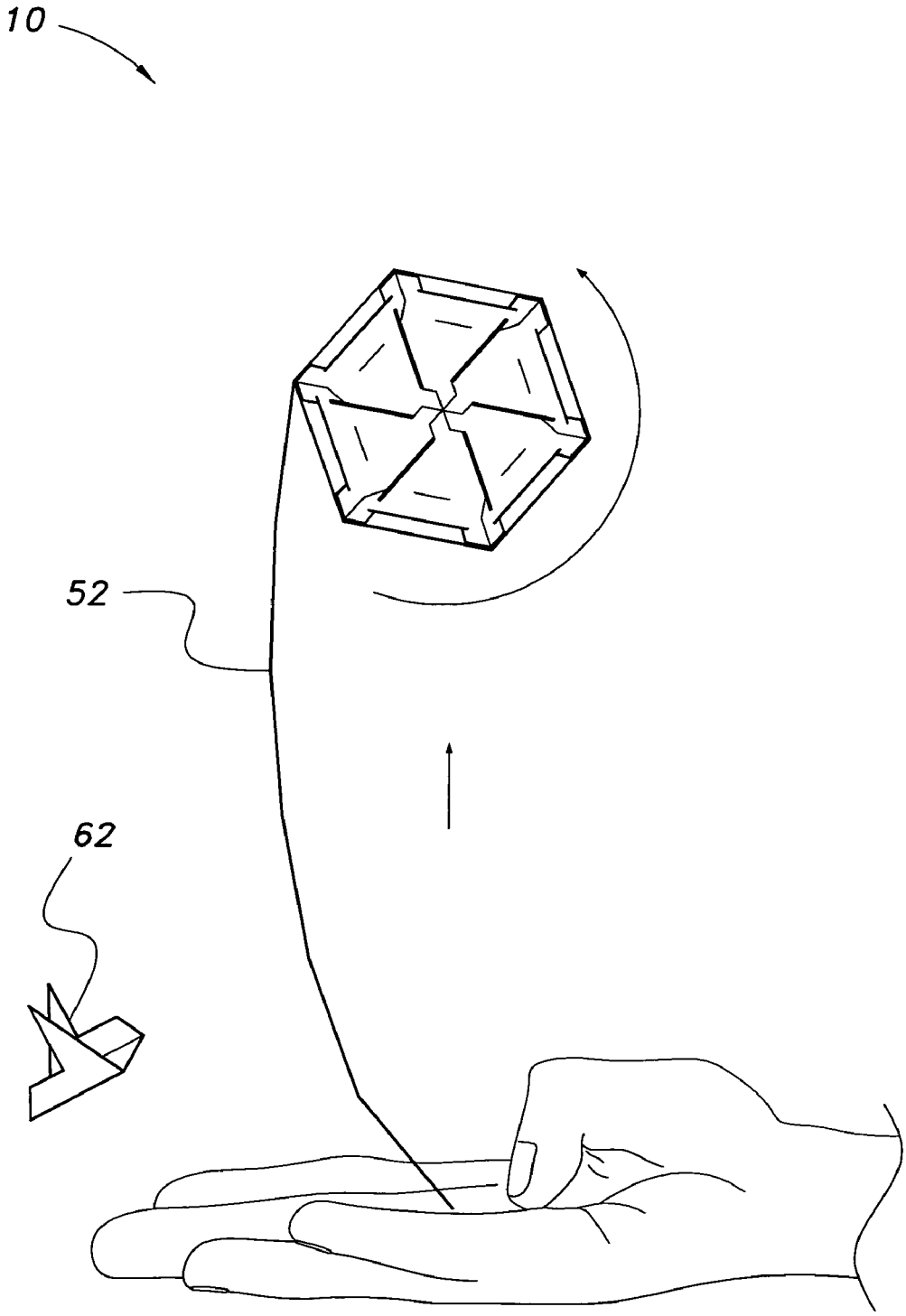
Figure 14D:
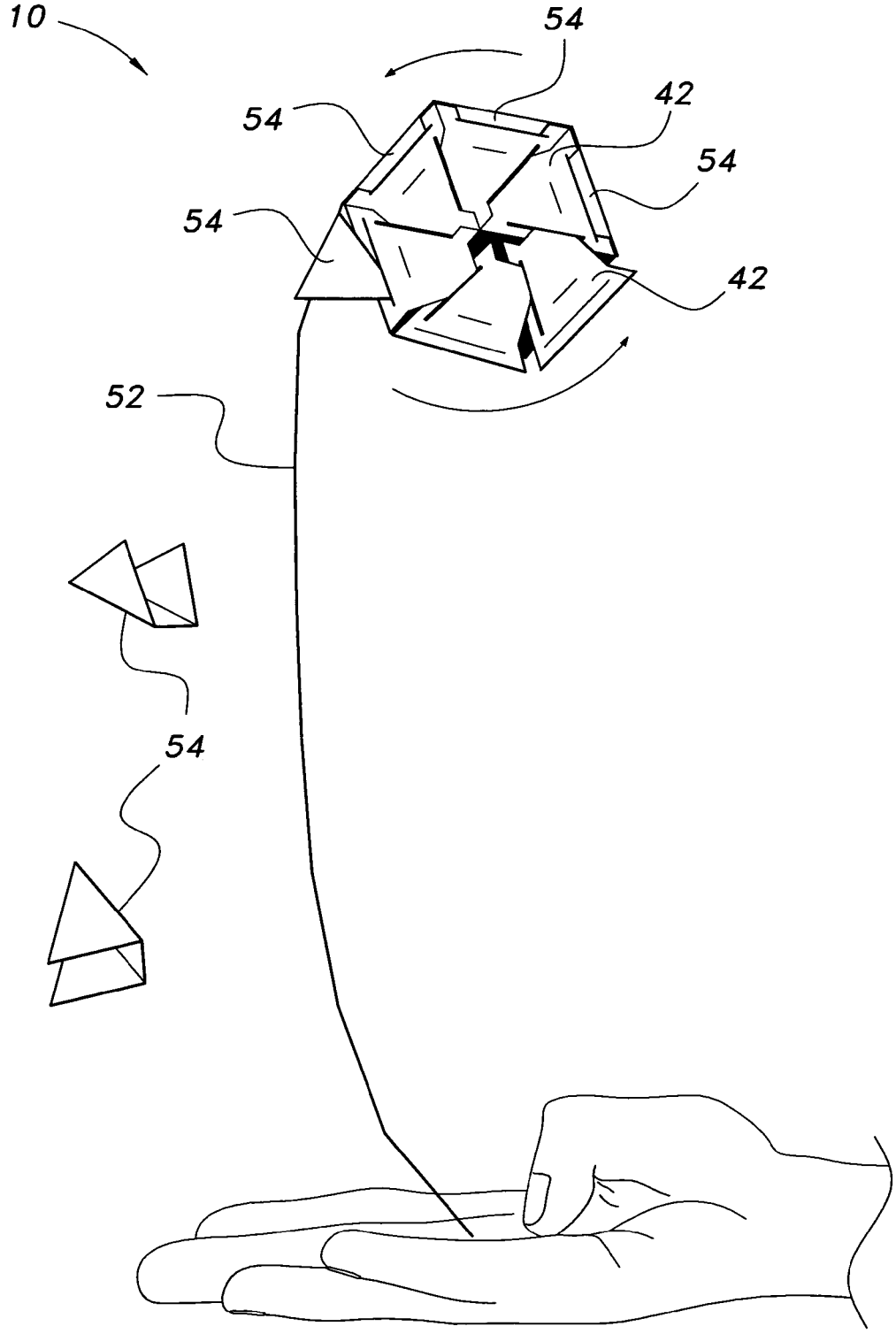

In use, the expansible amusement device 10 is first primed for deployment by unfolding the exposed ends of retaining tabs 66 and 68, above third slot 46. As shown in FIG. 14A, following the unfolding, the user grasps the free end 52*a* of the deployment strip 52 between his or her fingers, or, preferably, between his or her thumb and palm, and then tosses the expansible amusement device 10 in order to deploy the expansible amusement device 10. The tossing of the expansible amusement device 10, while the user grasps the free end 52*a* of the deployment strip 52, causes the secondary retaining member 62 to disengage from slots 46, 48 as the deployment strip 52 begins to unravel, as shown in FIGS. 14B and 14C. As shown in FIG. 14D, as the deployment strip 52 further unravels, the plurality of first retaining members 54 become disengaged, thus allowing the bases 40 to separate via the decompression of expandable members 12, as well as the individual base members 42 to separate from one another, resulting in the deployment of confetti 70, 72, base members 42, and the members 12, as shown in FIG. 1. The individual pieces of the expansible amusement device 10 may then be retrieved and the device 10 may be reassembled to be reused.

Figure 10:
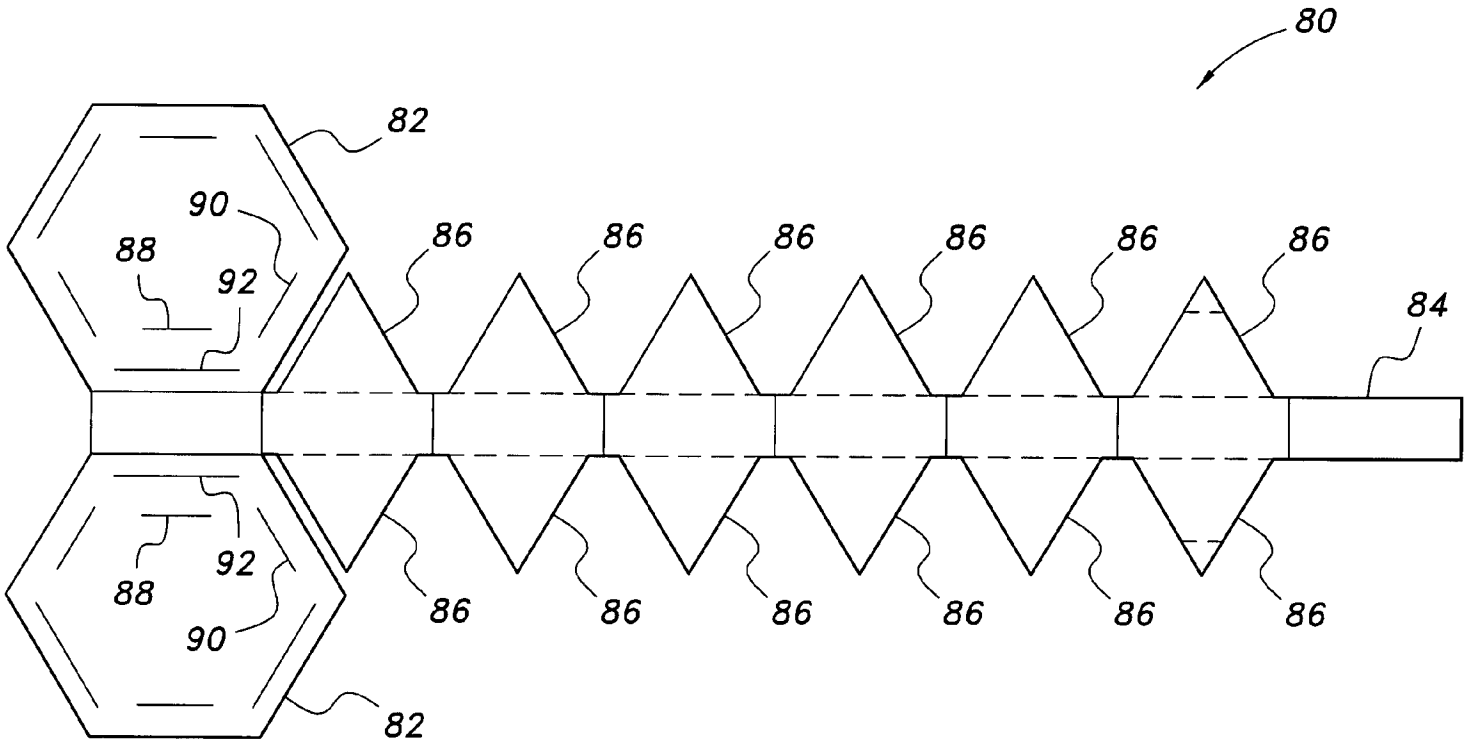
FIG. 10 is a plan view of a blank for forming an integral casing in an alternative embodiment of an expansible amusement device according to the present invention.

In the alternative embodiment of FIG. 10, deployment strip 52 is replaced by a deployment strip 84 that has a plurality of tabs 86 fixed thereto, as shown, with the tabs 86 being foldable to form the tab portions of the first retaining members. The fixed end of strip 84 is further secured to a pair of side edges of bases 82, with the tabs 86 being received within slots 90, 92. The two tabs 86, farthest from the bases 82 serve as the secondary retaining member, as described above, to secure the strip 84, with the retaining tabs thereof being received within the slots 92 and out through slots 88 of bases 82. Alternatively, the bases 82 may be detachable from the deployment strip 84, with the tabs 86 remaining fixed to strip 84, as shown.

Figure 11A:
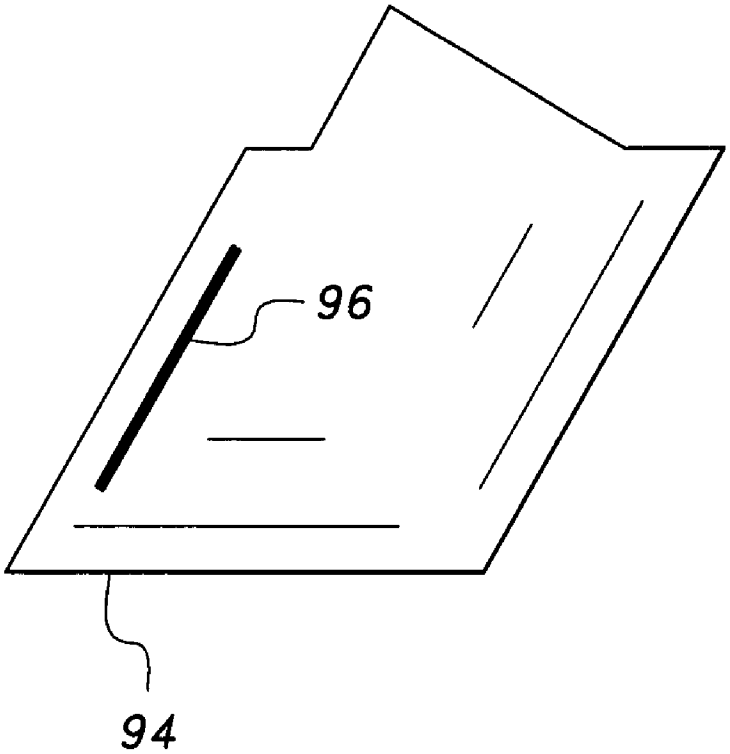
FIG. 11A is a plan view of a base member of another alternative embodiment of an expansible amusement device according to the present invention.
Figure 11B:
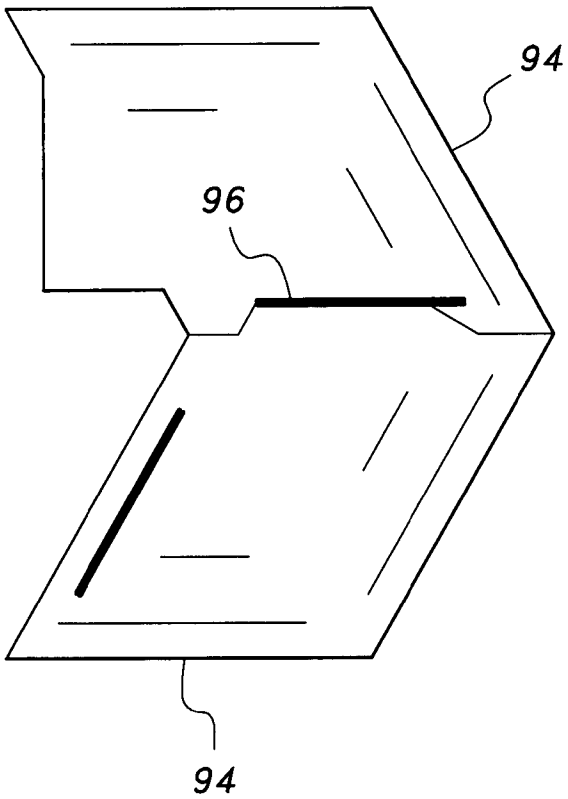
FIG. 11B is a plan view of a pair of joined base members of FIG. 11A.
Figure 11C:
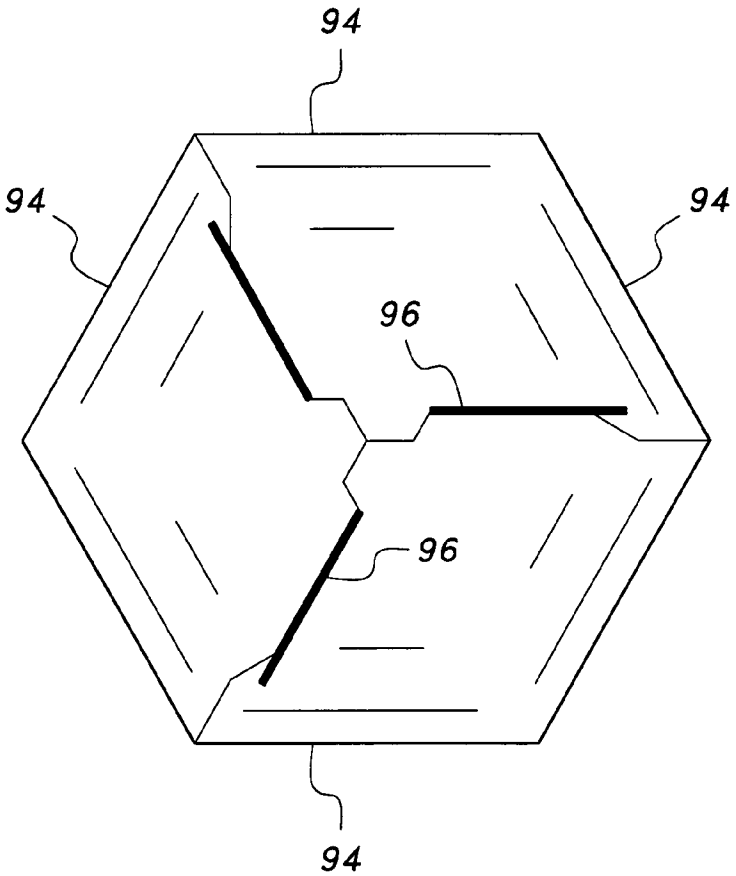
FIG. 11C is a plan view of an alternative base formed from the base members of FIGS. 11A and 11B.
Figure 12A:
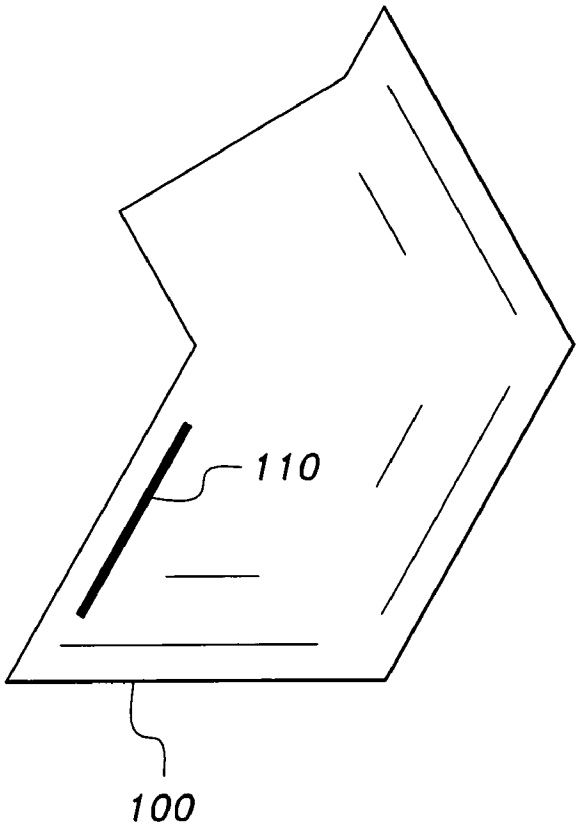
FIG. 12A is a plan view of a base member of another alternative embodiment of an expansible amusement device according to the present invention.
Figure 12B:
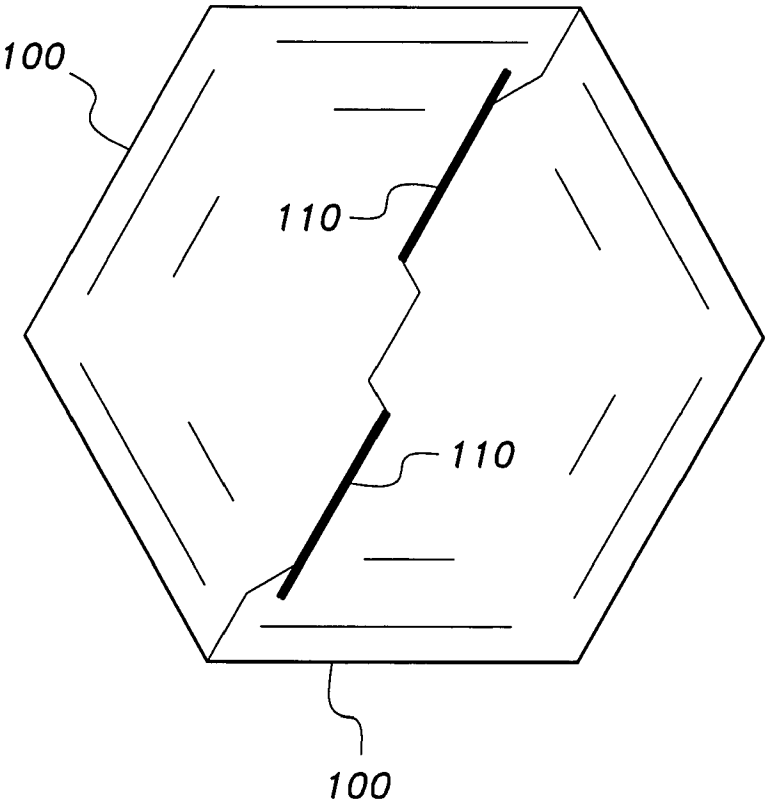
FIG. 12B is a plan view of an alternative base formed from a pair of base members of FIG. 12A.

In the alternative embodiment of FIGS. 11A-11C, the six individual base members 42 of FIG. 4A have been replaced by three base members 94. Essentially, pairs of base members 42 have been merged to form the base member 94 shown in FIG. 11A. The tab portion of each member 94 is inserted into a corresponding slot 96 of the adjacent member 94 to form the hexagonal base shown in FIG. 11C. In the alternative of FIG. 12A, three base members 42 of FIG. 4A have been merged to form a single base member 100. The tabs of two base members 100 are inserted into the complementary slots 110 to form the single base member shown in FIG. 12B.

It is to be understood that the present invention is not limited to the embodiments described above, but encompasses any and all embodiments within the scope of the following claims.

I claim:

1. An expansible amusement device, comprising:

a pair of substantially planar bases;

a plurality of elastically expandable members having a substantially planar shape when in a compressed state, the elastically expandable members being stacked and sandwiched between the pair of bases when in a compressed configuration;

a plurality of confetti strips positioned between adjacent ones of the elastically expandable members when in the compressed configuration;

a deployment strip peripherally wrapped about the pair of bases and the elastically expandable members when in the compressed configuration, the deployment strip having a free end and a fixed end; and at least one retaining member releasably securing the fixed end of the deployment strip to the pair of bases when in the compressed configuration;

wherein a user grasps the free end of the deployment strip and tosses the expansible amusement device in order to deploy the expansible amusement device, the tossing of the expansible amusement device causing the at least one retaining member and the deployment strip to separate from the pair of bases, the elastically expandable members expanding when compressive force from the pair of bases is removed, expansion of the plurality of elastically expandable members dispersing the plurality of confetti strips in a burst pattern.

2. The expansible amusement device as recited in claim 1, wherein each said elastically expandable member has a regular polyhedral shape in an uncompressed state.

3. The expansible amusement device as recited in claim 1, wherein each said elastically expandable member has a regular octahedral shape in an uncompressed state.

4. The expansible amusement device as recited in claim 1, wherein each said elastically expandable member is formed from a one-piece blank.

5. The expansible amusement device as recited in claim 4, wherein a plurality of openings are formed in opposed side edges of the one-piece blank, the expansible amusement device further comprising an elastic band received within and extending between the plurality of openings.

6. The expansible amusement device as recited in claim 4, wherein the one-piece blank has a plurality of air flow apertures formed therethrough.

7. The expansible amusement device as recited in claim 1, wherein each said base has a plurality of base members joined together.

8. The expansible amusement device as recited in claim 7, wherein each said base has a substantially hexagonal shape.

9. The expansible amusement device as recited in claim 7, wherein each said base member has a tab portion and first, second and third slots formed therethrough, each of the tab portions being received within a respective first slot of an adjacent one of said base members.

10. The expansible amusement device as recited in claim 9, wherein said at least one retaining member comprises a plurality of retaining members, each said retaining member having a pair of retaining tabs, each of the pair of retaining tabs being received by a respective pair of the second slots formed through a corresponding pair of the base members of said pair of bases.

11. The expansible amusement device as recited in claim 10, further comprising a secondary retaining member, the secondary retaining member having a pair of secondary retaining tabs, the pair of secondary retaining tabs being received by respective pairs of the second and third slots formed through a corresponding pair of the base members of said pair of bases, the secondary retaining member releasably securing a medial portion of said deployment strip to said pair of bases when in the compressed configuration, the medial portion being adjacent the free end thereof.

12. An expansible amusement device, comprising:

a pair of substantially planar bases;

a plurality of elastically expandable members having a substantially planar shape when in a compressed state, the elastically expandable members being stacked and sandwiched between the pair of bases to form a compressed stack;

a plurality of confetti strips loosely positioned between adjacent ones of the elastically expandable members in the compressed stack;

a deployment strip peripherally wrapped about the compressed stack, the deployment strip having a free end and a fixed end, the fixed end being fixed to the pair of bases; and a plurality of retaining members releasably securing a central portion of the deployment strip to the pair of bases in the compressed stack, whereby a user grasps the free end of the deployment strip and tosses the compressed stack in order to deploy the compressed stack, the tossing of the expansible amusement device causing the plurality of retaining members to disengage from the pair of bases and causing the deployment strip to unwind from about the pair of bases, the elastically expandable members expanding when compressive force from the pair of bases is removed, expansion of the elastically expandable members dispersing the confetti strips in a burst.

13. The expansible amusement device as recited in claim 12, wherein each said elastically expandable member has a regular polyhedral shape in an uncompressed state.

14. The expansible amusement device as recited in claim 12, wherein each said elastically expandable member has a regular octahedral shape in an uncompressed state.

15. The expansible amusement device as recited in claim 12, wherein each said elastically expandable member is formed from a one-piece blank.

16. The expansible amusement device as recited in claim 15, wherein a plurality of openings are formed in opposed side edges of the one-piece blank, the expansible amusement device further comprising an elastic band received within and extending between the plurality of openings.

17. The expansible amusement device as recited in claim 15, wherein the one-piece blank has a plurality of air flow apertures formed therethrough.

18. The expansible amusement device as recited in claim 12, wherein each said base has a regular polygonal shape.

19. The expansible amusement device as recited in claim 18, wherein each said base has a plurality of side edges, a plurality of slots being formed through each said base adjacent the respective side edges thereof.

20. The expansible amusement device as recited in claim 19, wherein said each said retaining member has a pair of retaining tabs, each of the pairs of retaining tabs being received by a respective pair of the slots formed through said pair of bases.

* * * * *